US011445318B2

(12) United States Patent
Khaleghimeybodi et al.

(10) Patent No.: US 11,445,318 B2
(45) Date of Patent: *Sep. 13, 2022

(54) HEAD-RELATED TRANSFER FUNCTION DETERMINATION USING CARTILAGE CONDUCTION

(71) Applicant: Meta Platforms Technologies, LLC, Menlo Park, CA (US)

(72) Inventors: Morteza Khaleghimeybodi, Bothell, WA (US); Vamsi Krishna Ithapu, Kirkland, WA (US); Antonio John Miller, Woodinville, WA (US)

(73) Assignee: Meta Platforms Technologies, LLC, Menlo Park, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/180,466

(22) Filed: Feb. 19, 2021

(65) Prior Publication Data

US 2021/0314720 A1 Oct. 7, 2021

Related U.S. Application Data

(63) Continuation of application No. 16/837,940, filed on Apr. 1, 2020, now Pat. No. 10,966,043.

(51) Int. Cl.
*H04S 7/00* (2006.01)
*H04R 1/10* (2006.01)

(52) U.S. Cl.
CPC ..... *H04S 7/30* (2013.01); *H04R 1/1091* (2013.01); *H04R 2460/13* (2013.01); *H04R 2499/15* (2013.01); *H04S 2420/01* (2013.01)

(58) Field of Classification Search
CPC ..... H04R 2460/13; H04R 1/1091; H04R 2499/15; H04S 2420/01; H04S 2400/15; H04S 7/30; H04S 7/301; H04S 7/303; G06F 3/012
USPC ..... 381/303, 58, 60, 326, 151
See application file for complete search history.

(56) References Cited

U.S. PATENT DOCUMENTS 10,356,231 B2 7/2019 Hosoi et al.
10,743,128 B1 * 8/2020 Johansson ..... G06V 40/165
2013/0342806 A1 * 12/2013 Sathe ..... H04R 1/46 381/151

(Continued)

OTHER PUBLICATIONS

PCT International Search Report and Written Opinion, PCT Application No. PCT/US2021/021289, dated May 19, 2021, 10 pages.

*Primary Examiner* — Norman Yu
(74) *Attorney, Agent, or Firm* — Fenwick & West LLP

(57) ABSTRACT

Embodiments relate to calibrating head-related transfer functions (HRTFs) for a user of an audio system (e.g., as a component of a headset) using cartilage conducted sounds. A test sound is presented to a user using a transducer (e.g., cartilage conduction) and an audio signal is responsively received via a microphone at an entrance to the user's ear canal. The test sound and audio signal combination may be provided to an audio server where a model is used to determine one or more HRTFs for the user. Information describing the one or more HRTFs is provided to the audio system to be used for providing audio to the user. The audio server may also use a model to determine geometric information describing a pinna of the user based on the combination. In one embodiment, the geometric information is used to determine the one or more HRTFs for the user.

20 Claims, 9 Drawing Sheets

(56) References Cited

U.S. PATENT DOCUMENTS

| | | | | |
|---|---|---|---|---|
| 2015/0181338 | A1* | 6/2015 | Hosoi | H04R 5/033<br>381/309 |
| 2015/0256943 | A1* | 9/2015 | Inagaki | H04R 1/46<br>381/60 |
| 2017/0026751 | A1 | 1/2017 | Suzuki et al. | |
| 2019/0373357 | A1 | 12/2019 | Khaleghimeybodi et al. | |

* cited by examiner

600

650

HEAD-RELATED TRANSFER FUNCTION DETERMINATION USING CARTILAGE CONDUCTION

CROSS REFERENCE TO RELATED APPLICATIONS

This application is a continuation of co-pending U.S. application Ser. No. 16/837,940, filed Apr. 1, 2020, which is incorporated by reference in its entirety.

FIELD OF THE INVENTION

This disclosure relates generally to audio systems, and more specifically to determining head-related transfer functions (HRTFs) using cartilage conduction.

BACKGROUND

A sound perceived at two ears can be different, depending on the direction and location of a sound source with respect to each ear as well as the environmental context in which the sound is perceived. Humans determine a location of the sound source by comparing the sound perceived at each ear. In an artificial reality context, "surround sound" (i.e., spatial audio) can be simulated using HRTFs. An HRTF characterizes how an ear receives a sound from a point in space. The HRTF for a particular source location relative to a person is unique to each ear of the person (and is unique to the person) due to the person's anatomy that affects the sound as it travels to the person's ears. As sound strikes the person, the size and shape of the person's head, ears, ear canal, size and shape of nasal and oral cavities transform the sound and affects how the sound is perceived by the user.

Conventionally, determining HRTFs for users of artificial reality systems is done by directly measuring HRTFs in a sound dampening chamber for many different source locations (e.g., typically more than a 100 speakers) relative to the user. The HRTFs may be used to generate a "surround sound" experience for the user while using an artificial reality system. Accordingly, for high quality surround sound, determining HRTFs is a relatively long process (e.g., more than an hour) requiring users to interact with specialized systems which are relatively complex (e.g., sound dampening chamber, one or more speaker arrays, scanning devices, etc.). Accordingly, conventional approaches for obtaining HRTFs are inefficient in terms of hardware resources and/or time needed.

SUMMARY

Embodiments relate to an audio system that determines head-related transfer functions (HRTFs) for a user. The audio system includes one or more cartilage conduction transducers, one or more acoustic sensors, and an audio controller. The audio system presents, via the one or more cartilage conduction transducers, various test sounds from locations on an ear (e.g., a pinna) of the user. The one or more microphones include at least one microphone placed at an entrance to an ear canal of the ear. The audio system receives, via the at least one microphone, audio signals resulting from the test sounds at the entrance to the ear canal of the user. Combinations of presented sounds and received audio signals may be used to determine corresponding HRTFs. In some embodiments, the HRTFs are directly determined using the test information and corresponding audio signals. In some embodiments, a pinna geometry may be determined using the test information and corresponding audio signals. And the pinna geometry may be used to, e.g., determine the HRTFs, used to design devices that are fitted to the ear of the user, etc. The audio system may use the determined HRTFs to generate three-dimensional spatialized audio for the user.

In some embodiments a method is described for determining one or more HRTFs of a user. Test information is received from an audio system. The test information describes an audio signal and test sound for a user. The audio signal corresponds to sound at an entrance to an ear canal of the user responsive to a cartilage conduction transducer coupled to a pinna of the user presenting the test sound to the user. One or more HRTFs are determined for the user using the test information and a model that maps combinations of audio signals and test sounds to corresponding HRTFs. Information is provided to the audio system describing the one or more HRTF to the audio system.

In some embodiments a method is described for determining geometric information describing a pinna of a user. Test information is received from an audio system. The test information describes an audio signal and test sound for the user. The audio signal corresponds to sound at an entrance to an ear canal of the user responsive to a cartilage conduction transducer coupled to a pinna of the user presenting the test sound to the user. Geometric information describing the pinna of the user is determined using the test information and a model that maps combinations of audio signals and test sounds to corresponding geometric information that describes the pinna of the user. The geometric information is provided to the audio system.

In some embodiments another method is described for determining one or more HRTFs of a user. Test information is received from an audio system. The test information describes an audio signal and test sound for a user. The audio signal corresponding to sound at an entrance to an ear canal of the pinna of the user responsive to a cartilage conduction transducer coupled to the pinna presenting the test sound to the user. Geometric information describing the pinna of the user is determined using the test information and a model that maps combinations of audio signals and test sounds to corresponding geometric information that describes the pinna of the user. One or more HRTFs for the user are determined using the geometric information. The information describing the one or more HRTFs is provided to the audio system.

Figure 1A:
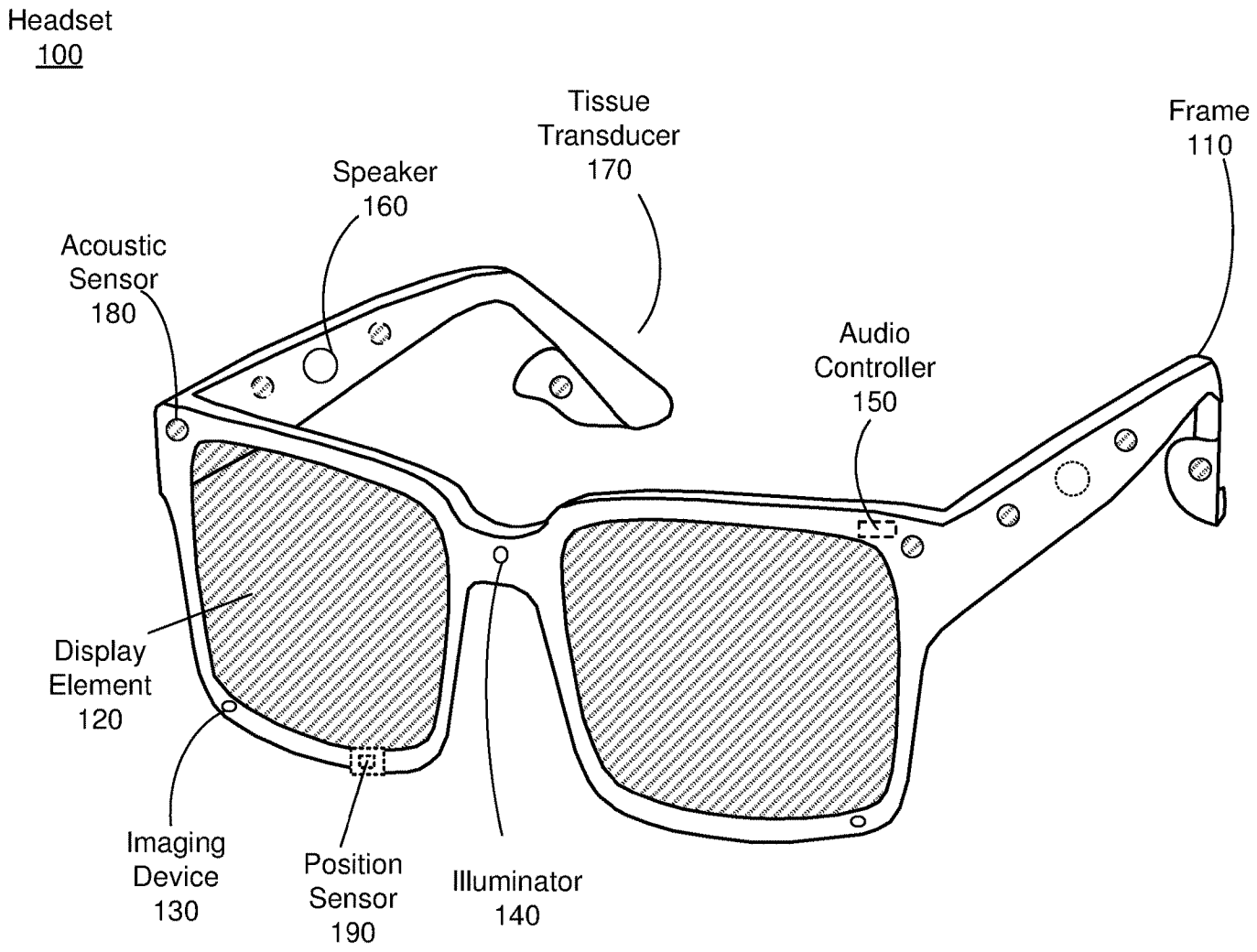
FIG. 1A is a perspective view of a headset implemented as an eyewear device, in accordance with one or more embodiments.

The figures depict various embodiments for purposes of illustration only. One skilled in the art will readily recognize from the following discussion that alternative embodiments of the structures and methods illustrated herein may be employed without departing from the principles described herein.

DETAILED DESCRIPTION

Configuration Overview

Embodiments of the invention may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to create content in an artificial reality and/or are otherwise used in an artificial reality. The artificial reality system that provides the artificial reality content may be implemented on various platforms, including a wearable device (e.g., headset) connected to a host computer system, a standalone wearable device (e.g., headset), a mobile device or computing system, or any other hardware platform capable of providing artificial reality content to one or more viewers.

A HRTF characterizes how an external ear (e.g., a pinna) of a user receives a sound from sound sources at particular positions relative to the ear. In some embodiments, an audio system presents test sounds to a user using one or more transducers (e.g., cartilage conduction transducer). In particular, audio system may present test sounds to one or both ears of the user using respective left ear and right ear transducers. The audio system may be part of a headset worn by the user. The audio system receives resulting audio signals (e.g., created by cartilage conduction transducers) via a microphone placed at an entrance of an ear canal of the user. The audio system may receive audio signals at one or both of a left ear microphone placed at the entrance to the left ear canal of the user and at a right ear microphone placed at an entrance to the right ear canal of the user.

The audio system uses the combinations of test sounds and audio signals to determine HRTFs customized to the user and/or geometric information of one or both pinnae of the user. In some embodiments, the audio system provides the combinations of test sounds and audio signals to a remote system (e.g., an audio server, a mobile phone of the user) remote from the audio system. The remote system may map the audio signals and test sounds to corresponding HRTFs and/or geometric information of the user using one or more machine learned models. In particular, the remote system may map the audio signals and test sounds to respective left ear HRTFs and/or geometric information and right ear HRTFs and/or geometric information. The remote system may further use the geometric information to determine one or more corresponding HRTFs (e.g., using a numerical simulation pipeline). After performing the mapping, the remote system may provide the HRTFs and/or the geometric information to the audio system.

In some embodiments, some or all of the functionality of the remote system may be performed by the audio system. For example, the remote system may provide one or more HRTF models and/or pinna geometry models to the audio system, and the audio system may use one or both of the HRTF models and the pinna geometry models to perform the mapping from test sound and audio signal combinations to corresponding HRTFs and/or geometric information of one or both pinnae of the user.

The remote system may use a training database of test sound and audio signal combinations collected for a set of training users (e.g., test subjects in a laboratory setting) to train the one or more HRTF models and/or the pinna geometry models. In particular, the remote system may train an HRTF model using test sound and audio signal combinations labeled with training HRTFs. The database may also include geometric information describing head-related and ear-related geometry of the set of training users. This geometric information may be captured by cameras and three-dimensional scanners. The remote system may train a pinna geometry model using test sound and audio signal combinations labeled with the geometric information. The remote system may also use the geometric information to perform HRTF simulation on this set of head-related and ear-related geometries to determine HRTFs for training the HRTF model or for providing to the audio system.

The audio system may use HRTFs determined for a user of the audio system to present sound content through an audio output device (e.g., speakers, headphones). In particular, the determined HRTFs may be used to provide spatialized audio to the user (e.g., via a transducer array).

The methods and systems described herein provide an efficient means for real-time HRTF calibration and/or head-related geometric information calibration for audio system users. In particular, the described system uses test sound and audio signal combinations for a user to determine corresponding HRTFs, which can be collected by the system with relative ease (vs. directly measuring HRTFs in a sound dampening chamber using large speaker arrays). Furthermore, the described system can collect information for constructing HRTFs without the user performing extra measures, such as taking images or videos of the head of the user, or some other means to capture physical dimensions of the head or ear.

Headset Examples

FIG. 1A is a perspective view of a headset 100 implemented as an eyewear device, in accordance with one or more embodiments. In some embodiments, the eyewear device is a near eye display (NED). In general, the headset 100 may be worn on the face of a user such that content (e.g., media content) is presented using a display assembly and/or an audio system. However, the headset 100 may also be used such that media content is presented to a user in a different manner. Examples of media content presented by the headset 100 include one or more images, video, audio, or some combination thereof. The headset 100 includes a frame, and may include, among other components, a display assembly including one or more display elements 120, a depth camera assembly (DCA), an audio system, and a position sensor 190. While FIG. 1A illustrates the components of the headset 100 in example locations on the headset 100, the components may be located elsewhere on the headset 100, on a peripheral device paired with the headset 100, or some combination thereof. Similarly, there may be more or fewer components on the headset 100 than what is shown in FIG. 1A.

The frame 110 holds the other components of the headset 100. The frame 110 includes a front part that holds the one or more display elements 120 and end pieces (e.g., temples) to attach to a head of the user. The front part of the frame 110 bridges the top of a nose of the user. The length of the end pieces may be adjustable (e.g., adjustable temple length) to fit different users. The end pieces may also include a portion that curls behind the ear of the user (e.g., temple tip, ear piece).

The one or more display elements 120 provide light to a user wearing the headset 100. As illustrated the headset includes a display element 120 for each eye of a user. In some embodiments, a display element 120 generates image light that is provided to an eyebox of the headset 100. The eyebox is a location in space that an eye of user occupies while wearing the headset 100. For example, a display element 120 may be a waveguide display. A waveguide display includes a light source (e.g., a two-dimensional source, one or more line sources, one or more point sources, etc.) and one or more waveguides. Light from the light source is in-coupled into the one or more waveguides which outputs the light in a manner such that there is pupil replication in an eyebox of the headset 100. In-coupling and/or outcoupling of light from the one or more waveguides may be done using one or more diffraction gratings. In some embodiments, the waveguide display includes a scanning element (e.g., waveguide, mirror, etc.) that scans light from the light source as it is in-coupled into the one or more waveguides. Note that in some embodiments, one or both of the display elements 120 are opaque and do not transmit light from a local area around the headset 100. The local area is the area surrounding the headset 100. For example, the local area may be a room that a user wearing the headset 100 is inside, or the user wearing the headset 100 may be outside and the local area is an outside area. In this context, the headset 100 generates VR content. Alternatively, in some embodiments, one or both of the display elements 120 are at least partially transparent, such that light from the local area may be combined with light from the one or more display elements to produce AR and/or MR content.

In some embodiments, a display element 120 does not generate image light, and instead is a lens that transmits light from the local area to the eyebox. For example, one or both of the display elements 120 may be a lens without correction (non-prescription) or a prescription lens (e.g., single vision, bifocal and trifocal, or progressive) to help correct for defects in a user's eyesight. In some embodiments, the display element 120 may be polarized and/or tinted to protect the user's eyes from the sun.

In some embodiments, the display element 120 may include an additional optics block (not shown). The optics block may include one or more optical elements (e.g., lens, Fresnel lens, etc.) that direct light from the display element 120 to the eyebox. The optics block may, e.g., correct for aberrations in some or all of the image content, magnify some or all of the image, or some combination thereof.

The DCA determines depth information for a portion of a local area surrounding the headset 100. The DCA includes one or more imaging devices 130 and a DCA controller (not shown in FIG. 1A), and may also include an illuminator 140. In some embodiments, the illuminator 140 illuminates a portion of the local area with light. The light may be, e.g., structured light (e.g., dot pattern, bars, etc.) in the infrared (IR), IR flash for time-of-flight, etc. In some embodiments, the one or more imaging devices 130 capture images of the portion of the local area that include the light from the illuminator 140. As illustrated, FIG. 1A shows a single illuminator 140 and two imaging devices 130. In alternate embodiments, there is no illuminator 140 and at least two imaging devices 130.

The DCA controller computes depth information for the portion of the local area using the captured images and one or more depth determination techniques. The depth determination technique may be, e.g., direct time-of-flight (ToF) depth sensing, indirect ToF depth sensing, structured light, passive stereo analysis, active stereo analysis (uses texture added to the scene by light from the illuminator 140), some other technique to determine depth of a scene, or some combination thereof.

The audio system provides audio content. The audio system includes a transducer array, a sensor array, and an audio controller 150. However, in other embodiments, the audio system may include different and/or additional components. Similarly, in some cases, functionality described with reference to the components of the audio system can be distributed among the components in a different manner than is described here. For example, some or all of the functions of the controller may be performed by a remote server.

The transducer array presents sound to user. The transducer array includes a plurality of transducers, including at least one tissue transducer A transducer may be a speaker 160 or a tissue transducer 170 (e.g., a bone conduction transducer or a cartilage conduction transducer). Although the speakers 160 are shown exterior to the frame 110, the speakers 160 may be enclosed in the frame 110. In some embodiments, instead of individual speakers for each ear, the headset 100 includes a speaker array comprising multiple speakers integrated into the frame 110 to improve directionality of presented audio content. The tissue transducer 170 couples to the head of the user and directly vibrates tissue (e.g., bone or cartilage) of the user to generate sound. The audio system may use the tissue transducer 170 to calibrate the audio system for providing audio to the user of the headset 100. In particular, the tissue transducer 170 may present test sounds to a user of the headset 100 for determining corresponding HRTFs and/or geometric information for the user. The tissue transducer 170 may be movable. For example, the transducer 170 may be slidable along portions the frame 110, attachable and detachable from certain positions on the frame 110, and/or possess any other functionality for being positioned at various locations on the headset 100. Collecting and using test sounds and audio signals via cartilage conduction is discussed in greater detail below with reference to FIGS. 2-6A/B. The number and/or locations of transducers may be different from what is shown in FIG. 1A.

The sensor array detects sounds within the local area of the headset 100. The sensor array includes a plurality of acoustic sensors 180. An acoustic sensor 180 captures sounds emitted from one or more sound sources in the local area (e.g., a room). Each acoustic sensor is configured to detect sound and convert the detected sound into an electronic format (analog or digital). The acoustic sensors 180 may be acoustic wave sensors, microphones, sound transducers, or similar sensors that are suitable for detecting sounds.

In some embodiments, one or more acoustic sensors 180 may be placed in an ear canal of each ear (e.g., acting as binaural microphones). In some cases the acoustic sensors 180 may always be present in the ear canal of each ear while the headset 100 is being used, while in other cases the acoustic sensors 180 may be removable (e.g., after the audio system is calibrated). The one or more acoustic sensors 180 may be used to receive audio signals in response to test sounds presented by the tissue transducer 170, which is discussed in greater detail below with reference to FIGS. 2 and 4. In some embodiments, the acoustic sensors 180 may be placed on an exterior surface of the headset 100, placed on an interior surface of the headset 100, separate from the headset 100 (e.g., part of some other device), or some combination thereof. The number and/or locations of acoustic sensors 180 may be different from what is shown in FIG. 1A. For example, the number of acoustic detection locations may be increased to increase the amount of audio information collected and the sensitivity and/or accuracy of the information. The acoustic detection locations may be oriented such that the microphone is able to detect sounds in a wide range of directions surrounding the user wearing the headset 100.

The audio controller 150 processes information from the sensor array that describes sounds detected by the sensor array. The audio controller 150 may comprise a processor and a computer-readable storage medium. The audio controller 150 may be configured to generate direction of arrival (DOA) estimates, generate acoustic transfer functions (e.g., array transfer functions and/or head-related transfer functions), track the location of sound sources, form beams in the direction of sound sources, classify sound sources, generate sound filters for the speakers 160, or some combination thereof.

The audio controller 150 additionally controls operations of the audio system. The audio controller collects test information for a user of headset 100, such as by using the tissue transducer 170. The audio controller 150 may prompt the user to position the tissue transducer 170 in various positions on the ear of the user in order to collect test information for calibrating an HRTF of the user and/or geometric information for the user. The user may opt in to allow the audio controller 150 to transmit data captured by the headset 100 (e.g., test information) to systems external to the headset, and the user may select privacy settings controlling access to any such data. For example, the audio controller 150 may transmit test information for a user to an audio server. The audio controller 150 may receive information describing one or more HRTFs for the user from the audio server based on the test information. Additionally, the audio controller 150 may receive geometric information from the audio server based on the test information. Embodiments of these processes performed by the audio controller and audio server are described in greater detail below with reference to FIGS. 2 and 5.

The position sensor 190 generates one or more measurement signals in response to motion of the headset 100. The position sensor 190 may be located on a portion of the frame 110 of the headset 100. The position sensor 190 may include an inertial measurement unit (IMU). Examples of position sensor 190 include: one or more accelerometers, one or more gyroscopes, one or more magnetometers, another suitable type of sensor that detects motion, a type of sensor used for error correction of the IMU, or some combination thereof. The position sensor 190 may be located external to the IMU, internal to the IMU, or some combination thereof.

In some embodiments, the headset 100 may provide for simultaneous localization and mapping (SLAM) for a position of the headset 100 and updating of a model of the local area. For example, the headset 100 may include a passive camera assembly (PCA) that generates color image data. The PCA may include one or more RGB cameras that capture images of some or all of the local area. In some embodiments, some or all of the imaging devices 130 of the DCA may also function as the PCA. The images captured by the PCA and the depth information determined by the DCA may be used to determine parameters of the local area, generate a model of the local area, update a model of the local area, or some combination thereof. Furthermore, the position sensor 190 tracks the position (e.g., location and pose) of the headset 100 within the room. Additional details regarding the components of the headset 100 are discussed below in connection with FIG. 7.

Figure 1B:
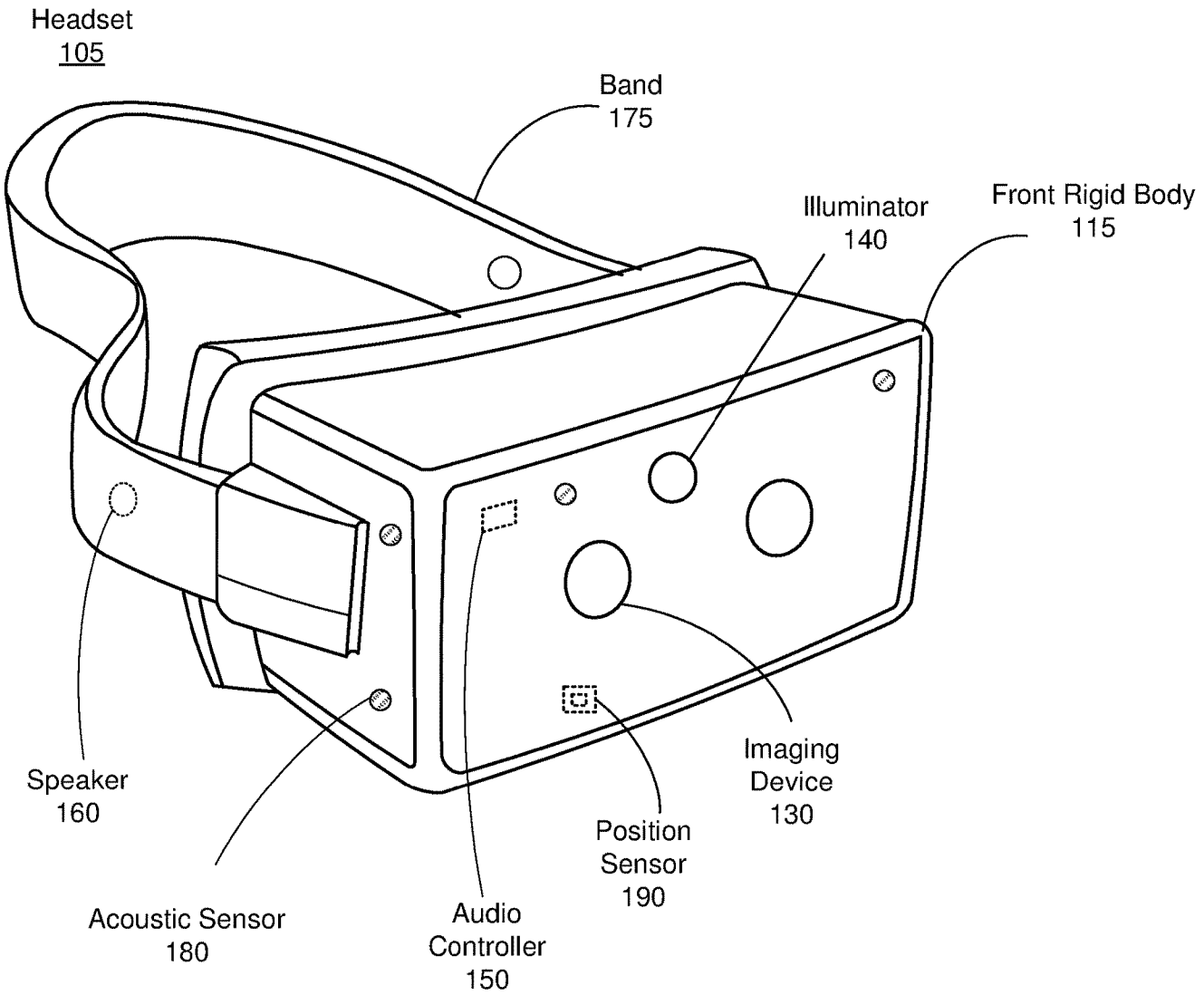
FIG. 1B is a perspective view of a headset implemented as a head-mounted display, in accordance with one or more embodiments.

FIG. 1B is a perspective view of a headset 105 implemented as an HMD, in accordance with one or more embodiments. In embodiments that describe an AR system and/or a MR system, portions of a front side of the HMD are at least partially transparent in the visible band (~380 nm to 750 nm), and portions of the HMD that are between the front side of the HMD and an eye of the user are at least partially transparent (e.g., a partially transparent electronic display). The HMD includes a front rigid body 115 and a band 175. The headset 105 includes many of the same components described above with reference to FIG. 1A, but modified to integrate with the HMD form factor. For example, the HMD includes a display assembly, a DCA, an audio system, and a position sensor 190. FIG. 1B shows the illuminator 140, a plurality of the speakers 160, a plurality of the imaging devices 130, a plurality of acoustic sensors 180, and the position sensor 190. The speakers 160 may be located in various locations, such as coupled to the band 175 (as shown), coupled to front rigid body 115, or may be configured to be inserted within the ear canal of a user.

System Environment for Determining HRTFs

Figure 2:
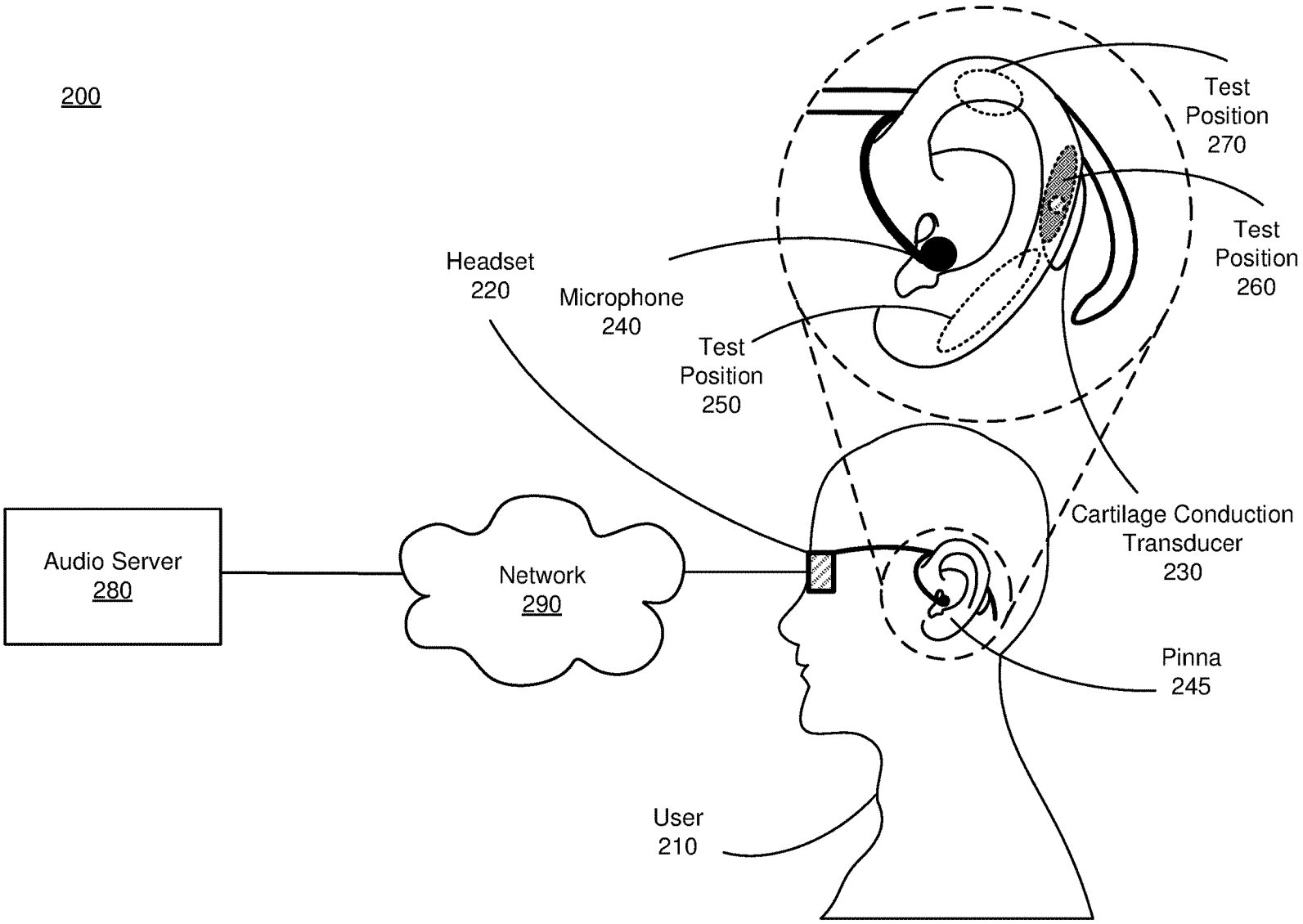
FIG. 2 is a block diagram of a system environment for determining HRTFs for a user of a headset device, in accordance with one or more embodiments.

FIG. 2 is a schematic diagram of a system 200 using cartilage conducted sounds to determine HRTFs customized to a user 210, in accordance with an embodiment. The user 210 wears a headset 220 that is coupled to an audio server 280 through a network 290. The headset 220 includes an audio system comprising a cartilage conduction transducer 230 and a microphone 240 for collecting cartilage conducted sounds to determine HRTFs and/or geometric information for the user 210. In other embodiments the audio system may be incorporated into other systems or devices than the headset 220. Some embodiments of the system 200 have different components than those described here. Similarly, in some cases, functions can be distributed among the components in a different manner than is described here.

The headset 220 is an eyewear device worn by the user 210. The headsets in FIG. 1A or FIG. 1B may be an embodiment of the headset 220. The audio system of the headset 220 (e.g., the audio systems of FIGS. 1A and 1B) may include multiple cartilage conduction transducers 230 (e.g., one for both ears of the user 210) and multiple microphones 240 or other acoustic sensors. Although only one side of the headset 220 and its functions in relation to a single pinna 245 of the user are depicted in FIG. 2, the description of the headset 220 herein may apply to both the left and right pinna of the user 210. The audio system is discussed in greater detail below with reference to FIG. 5.

The audio system of the headset 220 collects test information for the user 210. The audio system 220 may transmit collected test information to the audio server 280 over the network 290. The audio system may receive HRTFs and/or geometric information determined using the test information from the audio server 280. In alternative embodiments, the headset 220 processes the test information itself to determine HRTFs and/or geometric information of the ear of the user 210 corresponding to test sound and audio signal combinations. The term test information is audio data that describes test sounds and/or audio signals captured in response to the test sounds. Test information may include combinations of individual test sounds and an audio signal received in response to the test sound. For example, in some embodiments, test information includes combinations of test sounds presented by a transducer (e.g., a cartilage conduction transducer) at a position on the pinna of the user and corresponding audio signals captured (e.g., by a one or more acoustic sensors) at the entrance to the ear canal of the user. In some embodiments, the test information may also include characteristics of the transducer, such as a set of frequencies of test sounds which the transducer is capable of presenting. The audio signals themselves may corresponds to short or medium-term bursts of audio signals output from the cartilage conduction transducer 230. The frequency characteristics of these audio signals may be chosen specifically to extract certain useful test information that directly correlates with HRTFs for the user 210 or the geometric information of the ear of the user 210.

The cartilage conduction transducer 230 is configured to present one or more test sounds to the user 210 in accordance with instructions from the audio system of the headset 220. In some embodiments, the cartilage conduction transducer 230 is placed at various test positions on one or both pinnae of the user 210, and is configured to emit one or more test sounds at each of the test positions. For example, the cartilage conduction transducer 230 itself may be movable, such as slidable along portions the frame of the headset 220 (e.g. frame 110), and/or attachable and detachable from certain positions on the headset 220. As another example, the user 210 may reposition the entire frame of the headset 220 to move the cartilage conduction transducer 230. In the illustrated embodiment, the test positions include test positions 250, 260, and 270 on a pinna 245, which generally correspond to a top portion of the pinna 245, a middle portion of the pinna 245, and a lower portion of the pinna 245. The cartilage conduction transducer 230 is placed at the test position 260 in FIG. 2 (as indicated by the darkened portion of test position 260). The audio system may prompt the user to position the cartilage conduction transducer 230 in various positions on the pinna 245 of the user 210 in order to collect test information for the user 210. For example, the audio system may prompt the user to move the cartilage conduction transducer 230 to the test position 250 and/or the test position 270 after collecting one or more test sound and audio signal combinations at test position 260. Note the test positions 250, 260, and 270 are just illustrative, and other locations on the pinna 245 may be used as test positions. For example, there may be a test position on a tragus of the pinna 245.

The microphone 240 captures audio signals corresponding to sound at an entrance to an ear canal of the user 210. The sound may be from, e.g., a transducer (e.g., the cartilage conduction transducer 230, a transducer of a cartilage conduction transducer array), a speaker of a HRTF speaker array on the headset 220, or some combination thereof. In the illustrated embodiment, the audio signal is captured by microphone 240 at an entrance of an ear canal of the user 210, responsive to the cartilage conduction transducer 230 presenting a test sound. Additionally, in some embodiments, there is another microphone 240 that is positioned at the entrance to the ear canal of the other ear of the user 210. The microphone 240 provides the captured audio signals to other components of the audio system of the headset 220 (e.g., an audio controller).

The test information collected for the user 210 is sent to the audio server 280 by the audio system (e.g., via the headset 220 and network 290). The network 290 may be any suitable communications network for data transmission. In some example embodiments, network 290 is the Internet and uses standard communications technologies and/or protocols. Thus, network 290 can include links using technologies such as Ethernet, 802.11, worldwide interoperability for microwave access (WiMAX), 3G, 4G, digital subscriber line (DSL), asynchronous transfer mode (ATM), InfiniBand, PCI express Advanced Switching, etc. In some example embodiments, the entities use custom and/or dedicated data communications technologies instead of, or in addition to, the ones described above.

The audio server 280 processes the test information received from the audio system of the headset 220. The audio server 280 may process the test information in order to determine HRTFs for the headset user. The audio server 280 may use a HRTF model to predict an HRTF for a given test sound and audio signal combination. In some embodiments, the audio server 280 may determine geometric information for the user describing the geometry of the pinnae of the user. The geometric information refers to data which describes three-dimensional objects (e.g., via a three-dimensional mesh, collection of sub-shapes, a collection of surface normal on shapes, a collection of key points and landmarks on the shape in the form of a point cloud etc.). Geometric information may describe a geometry of some or all of one or both pinnae of the user. The audio server 280 may use a trained pinna geometry model to predict geometric information for a given test sound and audio signal combination. The audio server 280 may use the geometric information to determine HRTFs corresponding the test information. The audio server 280 may provide determined HRTFs and/or geometric information to the headset 220 to be used for one or more processes of the headset 220. For example, the headset 220 may use an HRTF to simulate spatialized audio for AR, VR, or MR. The audio server 280 is described in greater detail below with reference to FIGS. 3-4. In alternative embodiments, some or all of the processes performed by the audio server 280 may be performed by an audio system of a headset or other device (e.g., performed by the audio controller 150 of headset 100).

Figure 3:
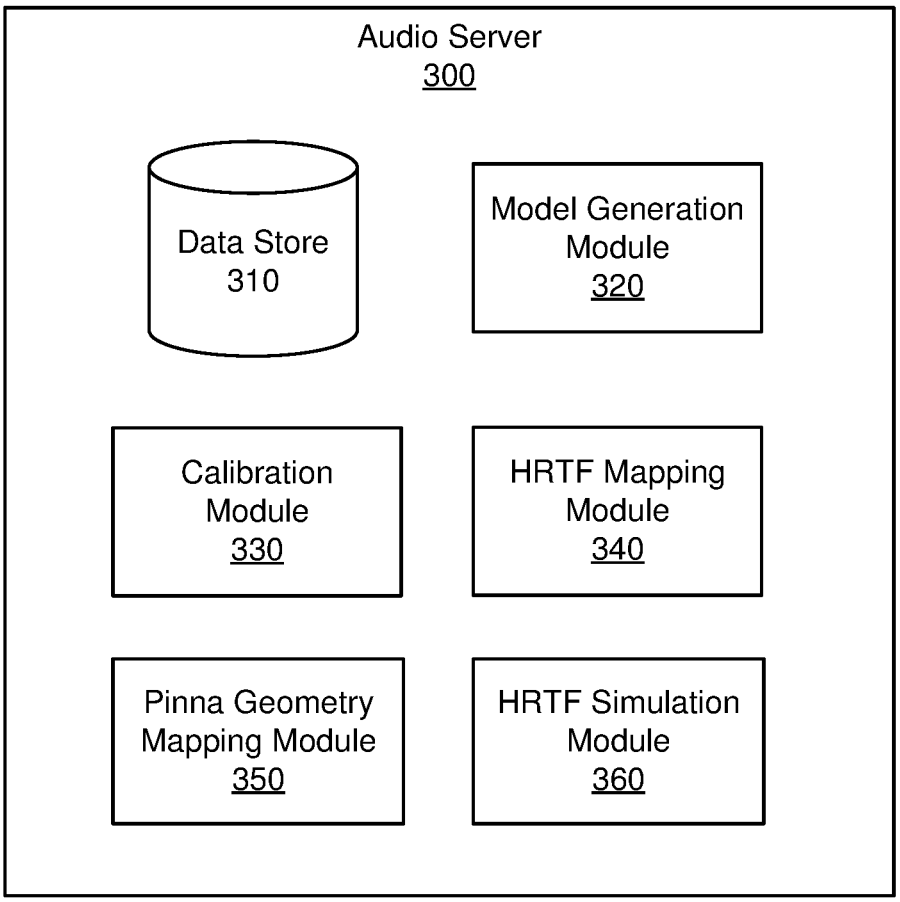
FIG. 3 is a block diagram of an audio server, in accordance with one or more embodiments.

FIG. 3 is a block diagram of audio server 300, in accordance with one or more embodiments. In the embodiment of FIG. 3, the audio server 300 includes a data store 310, a model generation module 320, a calibration module 330, an HRTF mapping module 340, a pinna geometry mapping module 350, and an HRTF simulation module 360. Some embodiments of the audio server 300 have different components than those described here. Similarly, in some cases, functions can be distributed among the components in a different manner than is described here.

The data store 310 stores data for use by the audio server 300. Data in the data store 310 may include, e.g., test information for one or more test positions, training test information for one or more test positions, HRTFs for one or more users, one or more models (e.g., HRTF model, pinna geometry model, etc.), head-related geometry information, pinna geometry, one or more test sounds, transducer characteristics, acoustic transfer functions of the microphones in the ear canals, and other data relevant for use by the audio server 300, or any combination thereof. Training test information is test information used to train one or more models. Training test information may include test sound and audio signal combinations captured for training users labeled with HRTFs (i.e., training HRTFs) and/or geometric information (i.e., training geometric information). Training test information may be captured for training using a training audio system, which is described in greater detail below with reference to FIG. 4.

The model generation module 320 uses training test information to train one or more models used by the audio server 300 to process test information received from an audio system (e.g., the audio system of the headset 220). The model generation module 320 may use the training test information (e.g., stored in the data store 310) to generate and/or update a model which maps test sound and audio signal combinations for a user to corresponding HRTFs for the user (i.e., an HRTF model). The HRTF model may output a representation of one or more HRTFs for the user. These representations may be a set of scalars for each location in the three-dimensional space (parameterized by the elevation, azimuth and radius in polar coordinate system). They may also be a set of numbers (e.g., under 100) which can be used with another set of impulse response basis functions to generate the HRTF. In some embodiments, a HRTF representation may also be a combination of a set of scalars and a set of numbers, as described above. Additionally, or alternatively, the model generation module 320 may use the training test information to generate a model which maps test sound and audio signal combinations to corresponding geometric information describing a pinna of a user (i.e., a pinna geometry model). The geometric information may be a set of key points of landmarks, or a set of two-dimensional projections of a three-dimensional object, or a mesh, or it may also be a dense or sparse point cloud. In some instantiations the geometric information may also be a set of scalars which can be used with a set of pretrained basis functions to generate the required information captured by a mesh of a point cloud.

The model generation module 320 determines HRTFs for one or more training users (i.e., training HRTFs). In some embodiments, the model generation module 320 uses head related geometry specific to the training user from which the training information was obtained as a ground truth for a shape of the pinnae of the training user. The model generation module 320 may simulate HRTFs for the training user specific to the head-related geometry (and in particular pinnae geometry) of the training user. The simulation may be the same as the simulation as performed by the HRTF simulation module 360 below. In some embodiments, the model generation module 320 receives HRTFs for one or more training users from an audio training system (e.g., as described below with regard to FIG. 4). In other embodiments, the model generation module 320 determines HRTFs for the one or more training users given audio sounds received via microphones at entrances to the ear canals responsive to test sounds emitted from an HRTF speaker array (e.g., as described below with regard to FIG. 4).

The model generation module 320 may train the one or more models using various supervised learning techniques, including but not limited to support vector machines, artificial neural networks, linear and kernelized regression, nearest neighbors, boosting and bagging, naïve bayes and Bayesian regression, decision trees, random forests, and related statistical and computational learning models. The model generation module 320 may train one or more models using information collected from the one or more training users. The information may include, for each training user, e.g., training test information (e.g., labeled combinations of test sounds and audio signals for a plurality of different test positions), head and ear related geometry that captures shape information of the two for the training user (in particular high resolution geometric information describing one or both pinnae), HRTFs for the user, characteristics of one or more transducers (i.e., those used to emit the test sounds), acoustic sensor transfer functions corresponding to acoustic sensors used to capture the audio signals for the test sounds, or some combination thereof. A trained model, given test information (e.g., captured audio signal for a given test sound) determined from a user, may output geometry information describing one or both pinnae of the user and/or information describing HRTFs of the user.

In some embodiments, the model generation module 320 generates a single trained model that can output geometry information describing one or both pinnae of the user and/or information describing HRTFs of the user. In other embodiments, the model generation module 320 generates a single trained model (i.e., a pinna geometry model) that can output geometry information describing one or both pinnae of the user based on test information from that user, and generates a single trained model (i.e., an HRTF model) that can output information describing HRTFs of the user based on the test information from that user. In some embodiments, the model generation module 320 generates a plurality of pinna geometry and/or HRTF models. For example, the test information received by the model generation module 320 may include test sounds presented from a plurality of test positions, as described below with reference to the calibration module 330. In this case, the model generation module 320 may train an HRTF model and/or a pinna geometry model for each test position from the plurality of test positions. As another example, the model generation module 320 may generate one or more separate HRTF models and/or pinna geometry models for each pinna of the user (e.g., a left ear HRTF model and a right ear HRTF model).

The calibration module 330 may facilitate data collection for use in one or more processes of the audio server 300. The calibration module 330 may communicate (e.g., via a network 290) with one or more audio systems (e.g., with the audio system of headset 220) in order to prompt users of the one or more audio systems to position a transducer at one or more positions on the users' pinnae in order to collect respective test information. For example, the calibration module 330 may generate instructions for prompting the user to position the transducer at one or more positions and provide the instructions to one or more audio systems. The one or more positions may correspond to one or more positions used to collect training test information used by the model generation module 320 to train the models. For example, the model generation module 320 may receive training test information from a training audio system including a training cartilage conduction transducer positioned at a certain position. In this case, the calibration module 330 may prompt the user to position the transducer at the same position as the training cartilage conduction transducer (e.g., test position 260). Collecting training test information with a training audio system is described in greater detail below with reference to FIG. 4. The calibration module 330 may instruct an audio system to obtain test information for a set of pre-defined test positions on one or both of the pinnae of a user. In some embodiments, a plurality of test sounds are emitted, and the plurality of test sounds are the same (e.g., same frequency or frequencies), and multiple audio signals are captured for the test sounds at each test position of the transducer. The multiple instances of data for a particular test sound emitted from a particular test position may help reduce error in the data during processing. In some embodiments, there are multiple test sounds emitted at each test position of the transducer, and at least one of the multiple test sounds is different from another test sound of the multiple test sounds. For example, there may be a set of test sounds that each have a different frequency (or range of frequencies), and the audio server 300 instructs the audio system to present some or all of the set of test sounds for each test position of the transducer. The audio server 300 receives (e.g., via the network 290) test information from the audio system.

In some embodiments, the calibration module 330 may update the one or more models using test information from the one or more audio systems. For example, the calibration module 330 may further train the one or more models using the information from users of the one or more audio systems. The information may include, for each user, e.g., test information (e.g., labeled combinations of test sounds and audio signals for a plurality of different test positions), characteristics of one or more transducers (i.e., those used to emit the test sounds), acoustic sensor transfer functions corresponding to acoustic sensors used to capture the audio signals for the test sounds, or some combination thereof. In this manner, the calibration module 330 may continue to increase the effectiveness of the one or more models in, e.g., predicting HRTFs and/or geometric information for a user given test information for that user.

The HRTF mapping module 340 maps combinations of test sounds and audio signals for a user to corresponding HRTFs using the HRTF model. The HRTF mapping module 340 may obtain test information from another component of the audio server 300 (e.g., the data store 310) and/or directly from an audio system (e.g., the audio system of headset 220). The HRTF mapping module 340 uses the HRTF model to map one or more of the test sound and audio signal combinations to information describing a set of HRTFs for the user. The information may be, e.g., the HRTFs for the user, a function and/or model that provides an HRTF given a test sound frequency and source position, some other information that may be used to determine HRTFs for the user, or some combination thereof. The HRTFs may be provided to the audio systems in one of several representational formats. These representations may be a set of scalars for each location in the three-dimensional space (parameterized by the elevation, azimuth and radius in polar coordinate system). They may also be a set of numbers (under 100) which when utilized with another set of impulse response basis functions will generate the HRTF. In some instantiations, a HRTF representation may also be a combination of both of the above.

In some embodiments, the HRTF mapping module 340 may compare the information output by the HRTF model for one or more of the test sound and audio signal combinations (e.g., combine, average, or otherwise process) in order to improve the accuracy of the set of HRTFs determined for the user. In some embodiments, the HRTF mapping module 340 also uses: (1) characteristics of the transducer used to obtain a given test sound and audio signal combination, and/or (2) a transfer function corresponding to the acoustic sensor used to capture the audio signal for a test sound and audio signal combination (e.g., a microphone transfer function), as inputs to the HRTF model to determine information describing the set of HRTFs for the user. The HRTF mapping module 340 may provide the information describing the set of HRTFs for the user to the audio system.

The pinna geometry mapping module 350 maps combinations of test sounds and audio signals for one or more users to corresponding geometric information describing a pinna of the one or more users using a pinna geometry model. The pinna mapping module 340 may obtain test information from another component of the audio server 300 (e.g., the data store 310) and/or directly from an audio system (e.g., the audio system of headset 220). The pinna geometry mapping module 350 may use a pinna geometry model to map test information (e.g., test sound and audio signal combinations) to corresponding geometric information describing a pinna of a user. In some embodiments, the pinna geometry mapping module 350 also uses: (1) characteristics of the transducer used to obtain a given test sound and audio signal combination, and/or (2) a transfer function corresponding to the acoustic sensor used to capture the audio signal for a test sound and audio signal combination (e.g., a microphone transfer function), as inputs to the pinna geometry model to determine geometric information describing a pinna of a user. The pinna geometry mapping module 350 may provide the geometric information to the audio system of the user, other components of the audio server 300 for further processing (e.g., to the HRTF simulation module 360), a manufacturing system, or some combination thereof.

The HRTF simulation module 360 simulates propagation of sound from an audio source at different locations relative to a simulated position of the head of the user to determine one or more HRTFs for the user. The HRTF simulation module 360 may use geometric information describing head related geometry (e.g., as output from the pinna geometry mapping module 350), and specifically ear related geometry, to determine the HRTF of the user. For example, the geometric information may include three-dimensional meshes of the head and/or pinna of the user. To determine simulated HRTFs the simulation module 350 may use a numerical simulation to simulate how sound propagates from a simulated sound source to the simulated ear canal of the user given the obtained geometric information (e.g., the pinna geometry and head/shoulder geometry of the user). For example, the HRTF simulation module 360 may determine simulated HRTFs using any of the methods described in U.S. Patent Application Ser. No. 62/670,628, entitled "Head-Related Transfer Function Personalization Using Simulation," filed on May 11, 2018, which is incorporated herein by reference. The HRTF simulation module 360 produces the simulated HRTF for the user based on the results of the simulation. In some embodiments, the HRTF simulation module 360 updates an HRTF model and/or a pinna geometry module based on the simulation results such that test sound and audio signal combinations and/or geometric information map to corresponding HRTFs.

In some embodiments, the geometric information determined by the pinna geometry mapping module 350 may be used for design and/or manufacture of a wearable device. For example, the audio server 300 and/or a manufacturing system may use the geometric information to generate a design file which describes a wearable device (e.g., an artificial reality headset) customized to fit the user corresponding to the geometric information. The design file may include information describing the geometry of a device which can be fitted to the ear of a user (e.g., an in-ear device), such as ear buds, other headphones, or tissue transducers. The design file may be used by, e.g., the manufacturing system, to fabricate an in-ear device based on the specifications of the design file. In doing so, the in-ear device may be customized to fit the ear of the user, such as fitting more tightly or matching the shape of the ear of the user. Furthermore, the in-ear device may be manufactured as a component of another device, such as a headset device (e.g., the headset 100 or the headset 105). In the same or different embodiment, the audio server 300 may store design files corresponding to a plurality of users (e.g., in data store 310). In this case, the server 300 or a third party may use one or more of the plurality of design files to generate an aggregated design file based on the one or more design files. For example, the aggregated design file may include average specifications across the one or more design files (e.g., average head diameter, average pinna circumference, etc.)

Figure 4:
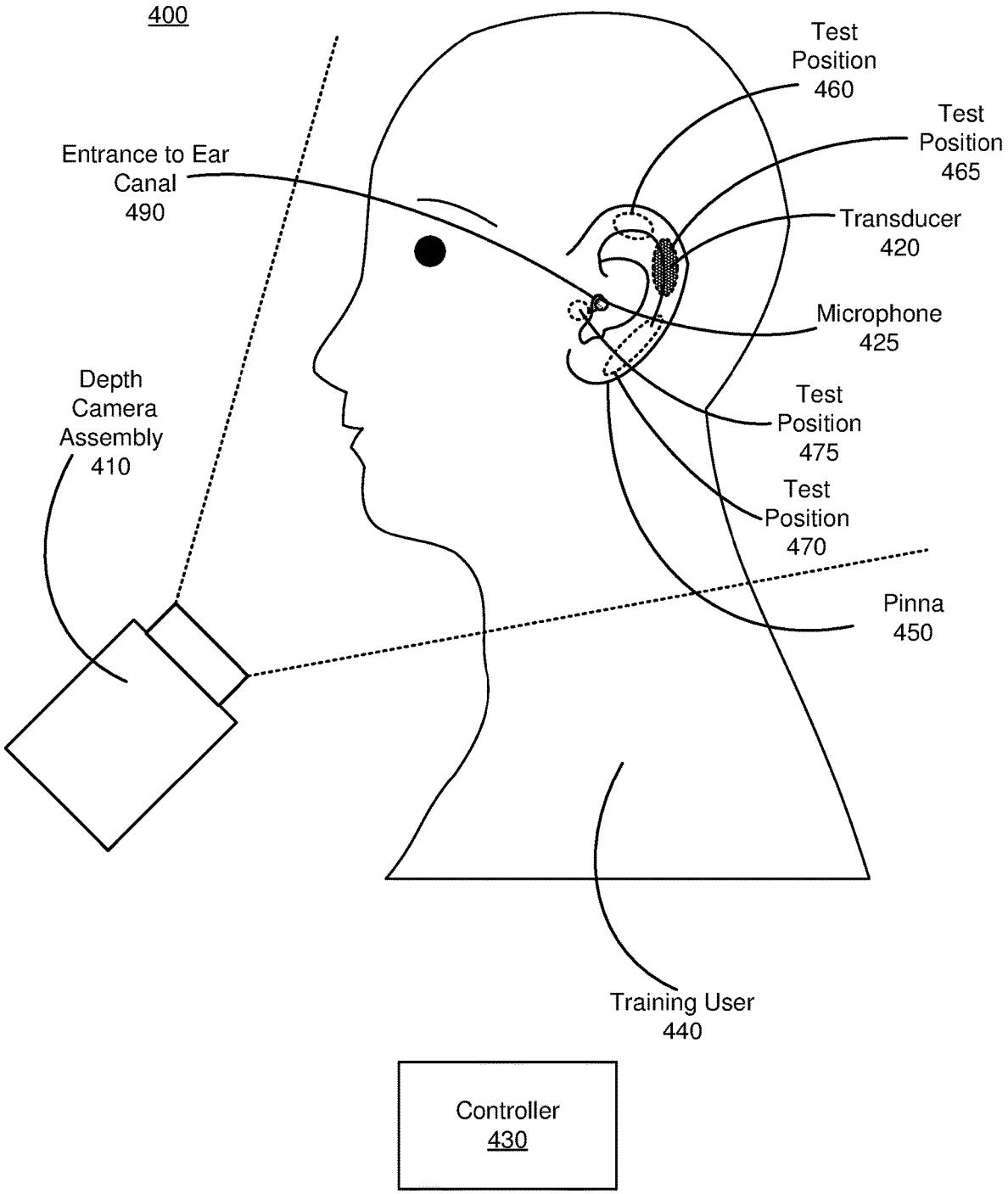
FIG. 4 is a perspective view of a system for collecting training test information for a training user, in accordance with an embodiment.

FIG. 4 is a perspective view of a training audio system 400 for collecting training test information for training users, in accordance with an embodiment. A training user (e.g., a training user 440) is a test subject from which information is determined (e.g., head-related geometric information, HRTFs) to train one or more models. A test subject may be a human or a physical model of a human. In the embodiment of FIG. 4, the training audio system 400 includes a DCA 410, one or more transducers (e.g., transducer 420), a microphone 425, and a controller 430. Some embodiments of the training audio system 400 have different components than those described here. Similarly, in some cases, functions can be distributed among the components in a different manner than is described here. In some embodiments, some or all of the components of the training audio system 400 are located in an anechoic chamber. As illustrated the training user 440 is not wearing a headset (e.g., the headset 100) that includes an audio system, however, in other embodiments, information is collected while the training user is wearing the headset. In these instances, portions of the training audio system 400 may also be part of the headset. For example, the transducer 320 and the microphone 425 may be part of the audio system of the headset. Furthermore, although only one side of the head, and a single pinna 450, of the training user 440 are depicted in FIG. 4, the description of the training audio system 400 herein applies to all sides of the head, and both the left and right pinna, of the user 440.

The DCA 410 collects geometric information describing head-related geometry of a plurality of training users (i.e., training geometric information). For example, in FIG. 4, the DCA 410 is collecting geometric information of a training user 440. The DCA 410 includes one or more imaging devices and may include a DCA controller (not shown in FIG. 4). In some embodiments, the one or more imaging devices are used to capture images, videos, or three-dimensional scans of portions of the ears and heads of the training users. The images include one or both pinnae of each of the training users. The DCA 410 may obtain image scans of a training user from several angles (e.g., by moving around the training user, prompting the user to rotate relative to the DCA 410, etc.). In some embodiments, the DCA 410 may obtain high-resolution scans of certain portions of a training user (i.e., pinna), while obtaining low-resolution scans of other portions of the training user (e.g., the head and shoulders). For each training user, the DCA 410 generates a head-related geometry using scans of that training user. For example, as illustrated the DCA 410 images a portion of a head of a training user 440. The portion of the head includes a pinna 450 of the training user. The DCA 410 generates a head related geometry of the imaged portion of the head. The head-related geometry describes a three-dimensional geometry of a head of a training user. The head-related geometry describes a three-dimensional geometry of one or both pinnae, and in some embodiments, may describe a three-dimensional geometry of other parts of the head, the shoulders, or some combination thereof. And in some instances, the head-related geometry may include a headset. In some instances, the headset may be worn by the training user while the head was scanned. In other embodiments, the headset is a three-dimensional virtual model of the headset that is combined with the three-dimensional model of the head of the training user to generate the head-related geometry. In some embodiments, the head-related geometry may be a three-dimensional mesh, a combination of representative three-dimensional shapes (e.g., voxels), some other representation of the scanned portion of the head of the training user, or some combination thereof.

The transducer 420 is configured to present one or more test sounds to a training user in accordance with instructions from the controller 430. As illustrated the transducer 420 is a cartilage conduction transducer used to collect training test information (i.e., a training cartilage conduction transducer). In some embodiments, the transducer 420 is placed at various test positions on one or both pinnae of a training user, and is configured to emit one or more test sounds at each of the test positions. These various test positions may each correspond to a position used by a headset device (e.g., headsets 100, 105, or 220) to collect test information for a user to determine HRTFs and/or geometric information for the user. For example, the headset device may include a transducer which is positioned at the same position as the test position 465, i.e., where the transducer 420 is currently positioned in FIG. 4. In the illustrated embodiment, the test positions include test positions 460, 465, 470, and 475, which generally correspond to a top portion of the pinna, a middle portion of the pinna, a lower portion of the pinna, and a tragus of the pinna, respectively. Note these portions are just illustrative, and other locations on the pinna may be used as test positions.

In embodiments not shown, the transducer 420 is replaced with a cartilage conduction transducer array that includes a plurality of cartilage conduction transducers. The cartilage conduction transducers may be located at different test positions on the pinna 450. For example, each pinna of a training user may be fitted with a cartilage conduction transducer array that is configured emit test sounds in accordance with instructions from the controller 430.

In other embodiments, the transducer 320 may some other type of transducer (e.g., air or bone). These other types of transducers may be placed in different test positions than those illustrated. For example, a test position for a bone conduction transducer could be located behind the pinna and be coupled to the skull (e.g., mastoid) instead of the pinna, an air conduction transducer could be located on a headset worn by the training user, etc.

Additionally, in some embodiments (not shown), the training audio system 400 includes an HRTF speaker array that includes a plurality of speakers positioned at different locations relative to a training user. Each of the speakers is positioned such that a sound emitted from the speaker is at a different relative position to the training user 440. The emitted sound may be, e.g., a chirp, a tone, etc.

The microphone 425 captures audio signals corresponding to sound at an entrance to an ear canal of a training user. The sound may be from, e.g., a transducer (e.g., the transducer 420, a transducer of a cartilage conduction transducer array), a transducer on a headset worn by the training user 440, a speaker of a HRTF speaker array, or some combination thereof. In the illustrated embodiment, the audio signal is captured at an entrance 490 of an ear canal of the training user 440, responsive to the transducer 420 presenting a test sound. Additionally, in some embodiments, there is another microphone 425 that is positioned at the entrance to the ear canal of the other ear of the training user 440. The microphone 425 provides the captured audio signals to the controller 430.

The controller 430 controls components of the training audio system 400. The controller 430 instructs the transducer 420, one or more transducers of a cartilage conduction transducer array, one or more transducers on a headset, one or more speakers of an HRTF speaker array, or some combination thereof to emit test sounds. The controller 430 receives audio signals corresponding to the test sounds from the microphone 425. In the illustrated embodiment, the controller 430 instructs the transducer 420 to emit one or more test sounds, corresponding audio signals are received from the microphone 425, the transducer 420 is then moved to a different test position (e.g., 460, 470, or 475), and then the process repeats. In this manner, the controller 430 collects test information (i.e., one or more audio signals and one or more corresponding test sounds) for each test position.

The controller 430 instructs the DCA 410 to generate head-related geometry for the training user 440. The head-related geometry including information describing a three-dimensional geometry of one or both pinnae of the training user 440. The controller 430 may instruct the DCA 410 to move to different positions (e.g., via one or more actuators) to capture scans of different portions of the training user 440 (e.g., side of head, face, shoulder, etc.).

The controller 430 may determine HRTFs for one or both ears of a training user. In embodiments, where the test sounds are emitted from an HRTF speaker array, the controller 430 may determine HRTFs for one or both ears of a training user based in part on the detected sounds. In other embodiments, the controller may use the head related geometry for the training user to simulate HRTFs for the training user. The simulation of HRTFs may be the same as the simulation describe above with reference the HRTFs simulation describe above with reference to FIG. 3.

The controller 430 may provide the test information, the head-related geometry described above, the HRTFs for one or both ears, or some combination thereof, to the audio server 280. The audio server 280 may use the received information to train one or more models (e.g., the HRTF model, the pinna geometry model). In other embodiments, the training audio system 400 may train the one or more models using the process described above with reference to FIG. 3. The training audio system 400 may then provide the trained one or more models to, e.g., the audio server 300. And in some embodiments, the trained one or more models may be installed locally on one or more audio systems (e.g., that are part of headsets).

Figure 5:
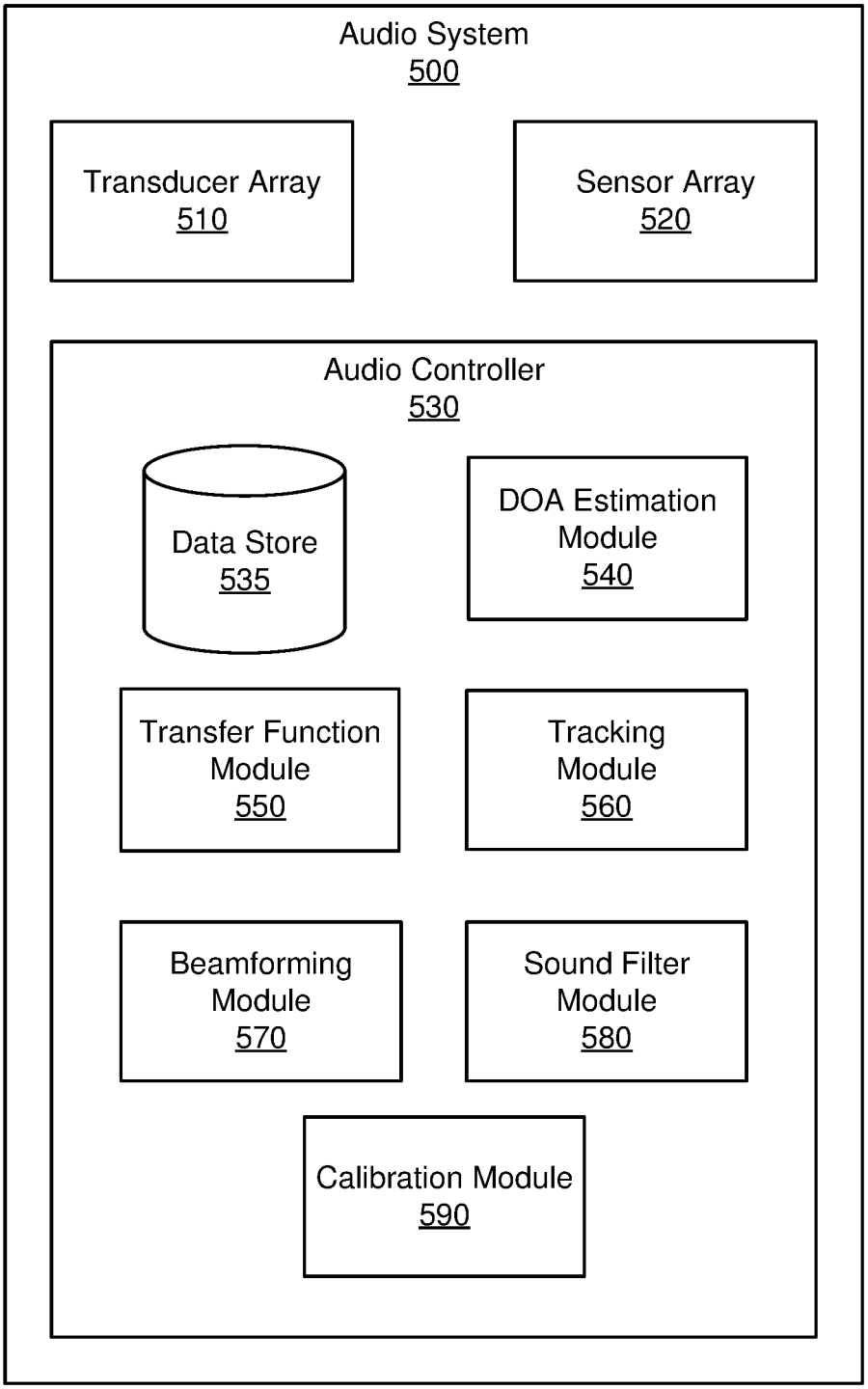
FIG. 5 is a block diagram of an audio system, in accordance with one or more embodiments.

FIG. 5 is a block diagram of an audio system 500, in accordance with one or more embodiments. The audio system in FIG. 1A, FIG. 1B, and/or FIG. 2 may be an embodiment of the audio system 500. The audio system 500 generates one or more acoustic transfer functions for a user. The audio system 500 may use the one or more acoustic transfer functions to generate audio content for the user. In the embodiment of FIG. 5, the audio system 500 includes a transducer array 510, a sensor array 520, and an audio controller 530. Some embodiments of the audio system 500 have different components than those described here. Similarly, in some cases, functions can be distributed among the components in a different manner than is described here.

The transducer array 510 is configured to present audio content. The transducer array 510 includes a plurality of transducers. A transducer is a device that provides audio content. A transducer may be, e.g., a speaker (e.g., the speaker 160), a tissue transducer (e.g., the tissue transducer 170), some other device that provides audio content, or some combination thereof. A tissue transducer may be configured to function as a bone conduction transducer or a cartilage conduction transducer. The transducer array 510 may present audio content via air conduction (e.g., via one or more speakers), via bone conduction (via one or more bone conduction transducer), via cartilage conduction audio system (via one or more cartilage conduction transducers), or some combination thereof. For example, in some embodiments, the transducer array 510 includes a single cartilage conduction transducer for each ear of the user. In some embodiments, the transducer array 510 may include one or more transducers to cover different parts of a frequency range. For example, a piezoelectric transducer may be used to cover a first part of a frequency range and a moving coil transducer may be used to cover a second part of a frequency range.

The bone conduction transducers generate acoustic pressure waves by vibrating bone/tissue in the user's head. A bone conduction transducer may be coupled to a portion of a headset, and may be configured to be behind the auricle coupled to a portion of the user's skull. The bone conduction transducer receives vibration instructions from the audio controller 530, and vibrates a portion of the user's skull based on the received instructions. The vibrations from the bone conduction transducer generate a tissue-borne acoustic pressure wave that propagates toward the user's cochlea, bypassing the eardrum.

The cartilage conduction transducers generate acoustic pressure waves by vibrating one or more portions of the auricular cartilage of the ears of the user. A cartilage conduction transducer may be coupled to a portion of a headset, and may be configured to be coupled to one or more portions of the auricular cartilage of the ear. For example, the cartilage conduction transducer may couple to the back of an auricle of the ear of the user. The cartilage conduction transducer may be located anywhere along the auricular cartilage around the outer ear (e.g., the pinna, the tragus, some other portion of the auricular cartilage, or some combination thereof). Vibrating the one or more portions of auricular cartilage may generate: airborne acoustic pressure waves outside the ear canal; tissue born acoustic pressure waves that cause some portions of the ear canal to vibrate thereby generating an airborne acoustic pressure wave within the ear canal; or some combination thereof. The generated airborne acoustic pressure waves propagate down the ear canal toward the ear drum.

The transducer array 510 generates audio content in accordance with instructions from the audio controller 530. In some embodiments, the audio content is spatialized. Spatialized audio content is audio content that appears to originate from a particular direction and/or target region (e.g., an object in the local area and/or a virtual object). For example, spatialized audio content can make it appear that sound is originating from a virtual singer across a room from a user of the audio system 500. The transducer array 510 may use HRTFs calibrated for the user to generate spatialized audio content. The transducer array 510 may be coupled to a wearable device (e.g., the headset 100 or the headset 105). In alternate embodiments, the transducer array 510 may be a plurality of speakers that are separate from the wearable device (e.g., coupled to an external console).

The sensor array 520 detects sounds within a local area surrounding the sensor array 520. The sensor array 520 may include a plurality of acoustic sensors that each detect air pressure variations of a sound wave and convert the detected sounds into an electronic format (analog or digital). The plurality of acoustic sensors may be positioned on a headset (e.g., headset 100 and/or the headset 105), on a user (e.g., in an ear canal of the user), on a neckband, or some combination thereof. The sensor array 520 includes microphones to be placed at an entrance of each ear canal. In some embodiments, these microphones are temporarily part of the sensor array 520 and may be removed from it (e.g., after calibration has occurred). An acoustic sensor may be, e.g., a microphone, a vibration sensor, an accelerometer, or any combination thereof. In some embodiments, the sensor array 520 is configured to monitor the audio content generated by the transducer array 510 using at least some of the plurality of acoustic sensors. Increasing the number of sensors may improve the accuracy of information (e.g., directionality) describing a sound field produced by the transducer array 510 and/or sound from the local area.

The audio controller 530 controls operation of the audio system 500. In the embodiment of FIG. 5, the audio controller 530 includes a data store 535, a DOA estimation module 540, a transfer function module 550, a tracking module 560, a beamforming module 570, a sound filter module 580, and a calibration module 590. The audio controller 530 may be located inside a headset, in some embodiments. Some embodiments of the audio controller 530 have different components than those described here. Similarly, functions can be distributed among the components in different manners than described here. For example, some functions of the controller may be performed external to the headset. The user may opt in to allow the audio controller 530 to transmit data captured by the headset to systems external to the headset, and the user may select privacy settings controlling access to any such data.

The data store 535 stores data for use by the audio system 500. Data in the data store 535 may include sounds recorded in the local area of the audio system 500, audio content, head-related transfer functions (HRTFs), transfer functions for one or more sensors, array transfer functions (ATFs) for one or more of the acoustic sensors, sound source locations, virtual model of local area, direction of arrival estimates, sound filters, geometric information, test sounds, audio signals captured by microphones at the entrances to the ear canals (e.g., responsive to presentation of test sounds), test position information (e.g., positions of transducers presenting test sounds), some other data relevant for use and/or calibration of the audio system 500, or some combination thereof.

The DOA estimation module 540 is configured to localize sound sources in the local area based in part on information from the sensor array 520. Localization is a process of determining where sound sources are located relative to the user of the audio system 500. The DOA estimation module 540 performs a DOA analysis to localize one or more sound sources within the local area. The DOA analysis may include analyzing the intensity, spectra, and/or arrival time of each sound at the sensor array 520 to determine the direction from which the sounds originated. In some cases, the DOA analysis may include any suitable algorithm for analyzing a surrounding acoustic environment in which the audio system 500 is located.

For example, the DOA analysis may be designed to receive input signals from the sensor array 520 and apply digital signal processing algorithms to the input signals to estimate a direction of arrival. These algorithms may include, for example, delay and sum algorithms where the input signal is sampled, and the resulting weighted and delayed versions of the sampled signal are averaged together to determine a DOA. A least mean squared (LMS) algorithm may also be implemented to create an adaptive filter. This adaptive filter may then be used to identify differences in signal intensity, for example, or differences in time of arrival. These differences may then be used to estimate the DOA. In another embodiment, the DOA may be determined by converting the input signals into the frequency domain and selecting specific bins within the time-frequency (TF) domain to process. Each selected TF bin may be processed to determine whether that bin includes a portion of the audio spectrum with a direct path audio signal. Those bins having a portion of the direct-path signal may then be analyzed to identify the angle at which the sensor array 520 received the direct-path audio signal. The determined angle may then be used to identify the DOA for the received input signal. Other algorithms not listed above may also be used alone or in combination with the above algorithms to determine DOA.

In some embodiments, the DOA estimation module 540 may also determine the DOA with respect to an absolute position of the audio system 500 within the local area. The position of the sensor array 520 may be received from an external system (e.g., some other component of a headset, an artificial reality console, an audio server, a position sensor (e.g., the position sensor 190), etc.). The external system may create a virtual model of the local area, in which the local area and the position of the audio system 500 are mapped. The received position information may include a location and/or an orientation of some or all of the audio system 500 (e.g., of the sensor array 520). The DOA estimation module 540 may update the estimated DOA based on the received position information.

The transfer function module 550 is configured to generate one or more acoustic transfer functions. Generally, a transfer function is a mathematical function giving a corresponding output value for each possible input value. Based on parameters of the detected sounds, the transfer function module 550 generates one or more acoustic transfer functions associated with the audio system. The acoustic transfer functions may be array transfer functions (ATFs), head-related transfer functions (HRTFs), other types of acoustic transfer functions, or some combination thereof. An ATF characterizes how the microphone receives a sound from a point in space.

An ATF includes a number of transfer functions that characterize a relationship between the sound source and the corresponding sound received by the acoustic sensors in the sensor array 520. Accordingly, for a sound source there is a corresponding transfer function for each of the acoustic sensors in the sensor array 520. And collectively the set of transfer functions is referred to as an ATF. Accordingly, for each sound source there is a corresponding ATF. Note that the sound source may be, e.g., someone or something generating sound in the local area, the user, or one or more transducers of the transducer array 510. The ATF for a particular sound source location relative to the sensor array 520 may differ from user to user due to a person's anatomy (e.g., ear shape, shoulders, etc.) that affects the sound as it travels to the person's ears. Accordingly, the ATFs of the sensor array 520 are personalized for each user of the audio system 500.

In some embodiments, the transfer function module 550 determines one or more HRTFs for a user of the audio system 500. The HRTF characterizes how an ear receives a sound from a point in space. The HRTF for a particular source location relative to a person is unique to each ear of the person (and is unique to the person) due to the person's anatomy (e.g., ear shape, shoulders, etc.) that affects the sound as it travels to the person's ears. In some embodiments, the transfer function module 550 may determine HRTFs for the user using a calibration process, as described below in relation to the calibration module 590. In some embodiments, the transfer function module 550 may provide information about the user to a remote system (e.g., the audio system 210). The user may adjust privacy settings to allow or prevent the transfer function module 550 from providing the information about the user to any remote systems. The remote system determines a set of HRTFs that are customized to the user using, e.g., machine learning, and provides the customized set of HRTFs to the audio system 500.

The tracking module 560 is configured to track locations of one or more sound sources. The tracking module 560 may compare current DOA estimates and compare them with a stored history of previous DOA estimates. In some embodiments, the audio system 200 may recalculate DOA estimates on a periodic schedule, such as once per second, or once per millisecond. The tracking module may compare the current DOA estimates with previous DOA estimates, and in response to a change in a DOA estimate for a sound source, the tracking module 560 may determine that the sound source moved. In some embodiments, the tracking module 260 may detect a change in location based on visual information received from the headset or some other external source. The tracking module 560 may track the movement of one or more sound sources over time. The tracking module 560 may store values for a number of sound sources and a location of each sound source at each point in time. In response to a change in a value of the number or locations of the sound sources, the tracking module 560 may determine that a sound source moved. The tracking module 560 may calculate an estimate of the localization variance. The localization variance may be used as a confidence level for each determination of a change in movement.

The beamforming module 570 is configured to process one or more ATFs to selectively emphasize sounds from sound sources within a certain area while de-emphasizing sounds from other areas. In analyzing sounds detected by the sensor array 520, the beamforming module 570 may combine information from different acoustic sensors to emphasize sound associated from a particular region of the local area while deemphasizing sound that is from outside of the region. The beamforming module 570 may isolate an audio signal associated with sound from a particular sound source from other sound sources in the local area based on, e.g., different DOA estimates from the DOA estimation module 540 and the tracking module 560. The beamforming module 570 may thus selectively analyze discrete sound sources in the local area. In some embodiments, the beamforming module 570 may enhance a signal from a sound source. For example, the beamforming module 570 may apply sound filters which eliminate signals above, below, or between certain frequencies. Signal enhancement acts to enhance sounds associated with a given identified sound source relative to other sounds detected by the sensor array 520.

The sound filter module 580 determines sound filters for the transducer array 510. In some embodiments, the sound filters cause the audio content to be spatialized, such that the audio content appears to originate from a target region. The sound filter module 580 may use HRTFs and/or acoustic parameters to generate the sound filters. The acoustic parameters describe acoustic properties of the local area. The acoustic parameters may include, e.g., a reverberation time, a reverberation level, a room impulse response, etc. In some embodiments, the sound filter module 580 calculates one or more of the acoustic parameters. In some embodiments, the sound filter module 280 requests the acoustic parameters from an audio server (e.g., as described below with regard to FIG. 7).

The sound filter module 580 provides the sound filters to the transducer array 510. In some embodiments, the sound filters may cause positive or negative amplification of sounds as a function of frequency.

The calibration module 590 calibrates the audio system 500 to the user. In some embodiments, the calibration module 590 prompts the user to position one or more transducers (e.g., cartilage conduction) of the transducer array 510 at corresponding test positions on one or both pinnae of the user. For example, the calibration module 590 may use a component of the audio system 500 (e.g., a speaker) to emit voice commands instructing the user where to position the transducers (e.g., "place the transducer at the top of your ear"). At each of the test positions, the calibration module 590 instructs the one or more transducers to present one or more test sounds. The calibration module 590 receives a set of corresponding audio signals from acoustic sensors (part of the sensor array 520) that are placed at the entrance to the ear canals of the user. The calibration module 590 then prompts the user to move the transducer to a different test position (e.g., tragus, bottom of the ear, etc.). The calibration module 590 instructs the transducer to emit one or more test sounds at the new test position, corresponding audio signals are received from the acoustic sensors at the entrance to the ear canals, and then the process repeats. In this manner, the calibration module 590 collects test information (i.e., one or more audio signals and one or more corresponding test sounds) for each test position of a plurality of test positions. The calibration module 590 may present each test sound based on certain data collection criteria, such as presenting each test sound a certain number of times (e.g., five times each) in order to collect a statistically significant data sample. In some embodiments, the calibration module 590 provides the test information to the audio server 280. The calibration module 590 then receives information describing one or more HRTFs from the user from the audio server 280. Alternatively, some processes of the audio server 280 may be performed locally by the calibration module 590. For example, in some embodiments, the calibration module 590 may use one or more models (e.g., the HRTF model) and the test information to determine HRTFs for the user.

Methods for Determining HRTFs

Figure 6A:
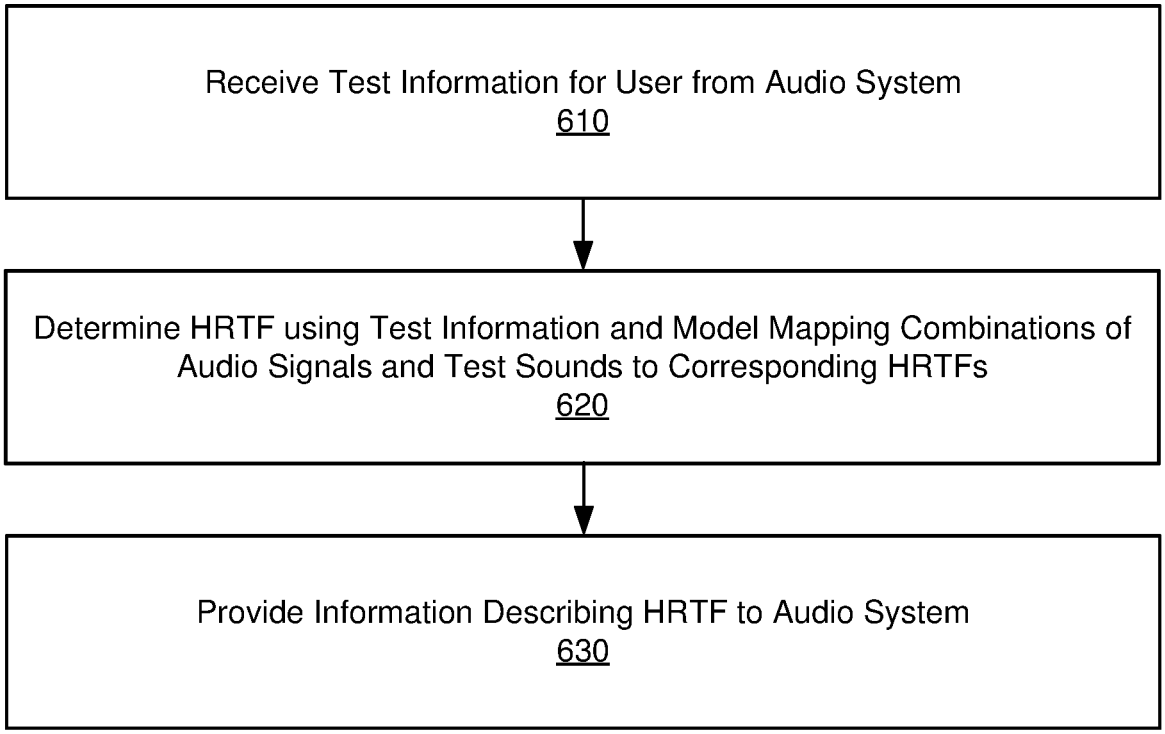
FIG. 6A is a flowchart illustrating a process for determining HRTFs using test information for a user, in accordance with one or more embodiments.

FIG. 6A is a flowchart illustrating a process 600 for determining HRTFs using test information for a user, in accordance with one or more embodiments. The process 600 shown in FIG. 6A may be performed by components of an audio server (e.g., audio server 300). Other entities may perform some or all of the steps in FIG. 6A in other embodiments. Embodiments may include different and/or additional steps, or perform the steps in different orders.

The audio server 300 receives 610 test information for a user of an audio system including a test sound and an audio signal. The test information may have been collected by the audio system (e.g., the audio system 500) by presenting the test sound using a cartilage conduction transducer and responsively receiving the audio signal via a microphone at an entrance to the ear canal of the user. For example, audio system 500 may collect the test sound and audio signal combination and provide the combination to the audio server 300.

The audio server 300 determines 620 an HRTF for the user using the received test information and a machine learned model which maps combinations of audio signals and test sounds to corresponding HRTFs. For example, the audio server 300 may apply the test sound and audio signal combination to a HRTF model to determine an HRTF corresponding to the combination. In other embodiments, the audio server 300 applies the test sound and audio signal combination to a geometry model to determine a geometry of a pinna of the user. The audio server 300 may then simulate HRTFs for that ear of the user based on the determined geometry of the pinna.

The audio server 300 provides 630 the HRTF to the audio system. For example, the audio server 300 may provide the HRTF to the audio system 500. The audio system may use the provided HRTF for presenting spatialized audio to the user.

Figure 6B:
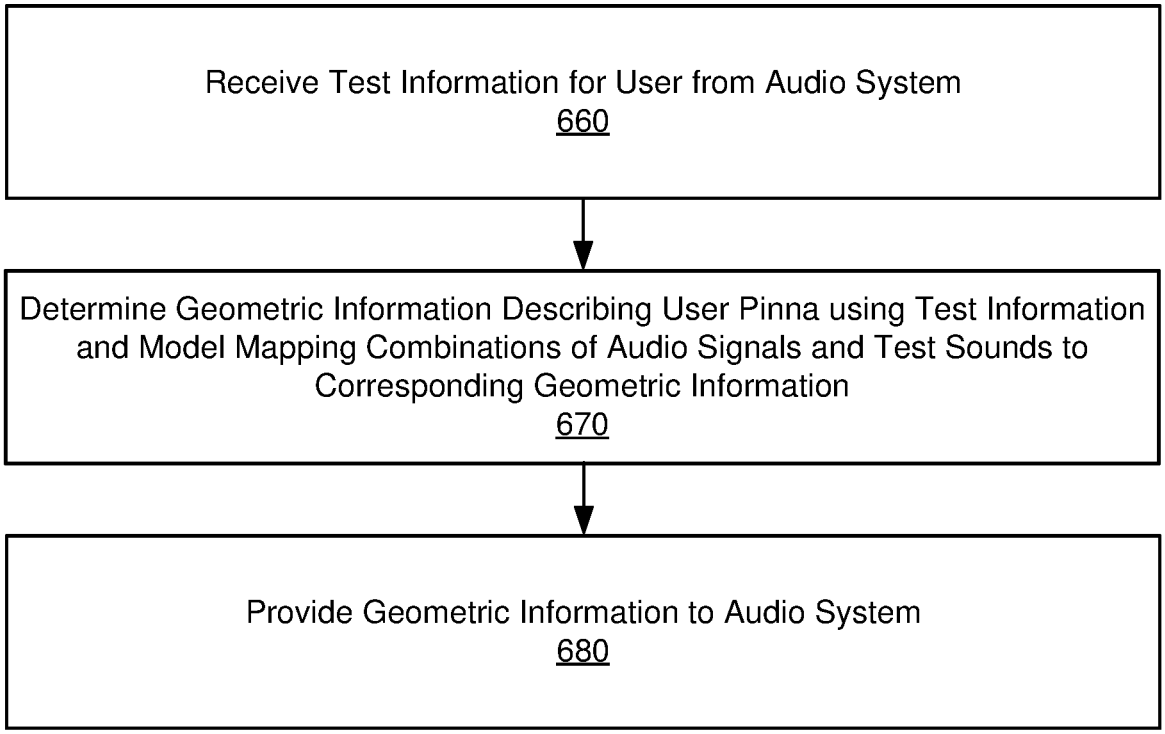
FIG. 6B is a flowchart illustrating a process for determining geometric information describing a pinna of a user using test information for the user, in accordance with one or more embodiments.

FIG. 6B is a flowchart illustrating a process 650 for determining geometric information describing a pinna of a user using test information for the user, in accordance with one or more embodiments. The process 650 shown in FIG. 6B may be performed by components of an audio server (e.g., audio server 300). Other entities may perform some or all of the steps in FIG. 6B in other embodiments. Embodiments may include different and/or additional steps, or perform the steps in different orders.

The audio server 300 receives 660 test information for a user of an audio system including a test sound and an audio signal. As described above in relation to process 600, the test information may have been collected by the audio system (e.g., the audio system 500) by presenting the test sound using a cartilage conduction transducer and responsively receiving the audio signal via a microphone at an entrance to the ear canal of the user.

The audio server 300 determines 670 geometric information describing a pinna of the user using the received test information and a machine learned model which maps combinations of audio signals and test sounds to corresponding geometric information. For example, the audio server 300 may apply the test sound and audio signal combination to a trained pinna geometry model to determine geometric information corresponding to the combination.

The audio server 300 provides 680 the geometric information to the audio system. For example, the audio server 300 may provide the pinna geometry to the audio system 500. The audio system may use the provided geometric information for determining an HRTF for the user. In the same or different embodiment, the audio server uses the geometric information to determine one or more HRTFs for the user, and may further provide the one or more HRTFs to the audio system.

Figure 7:
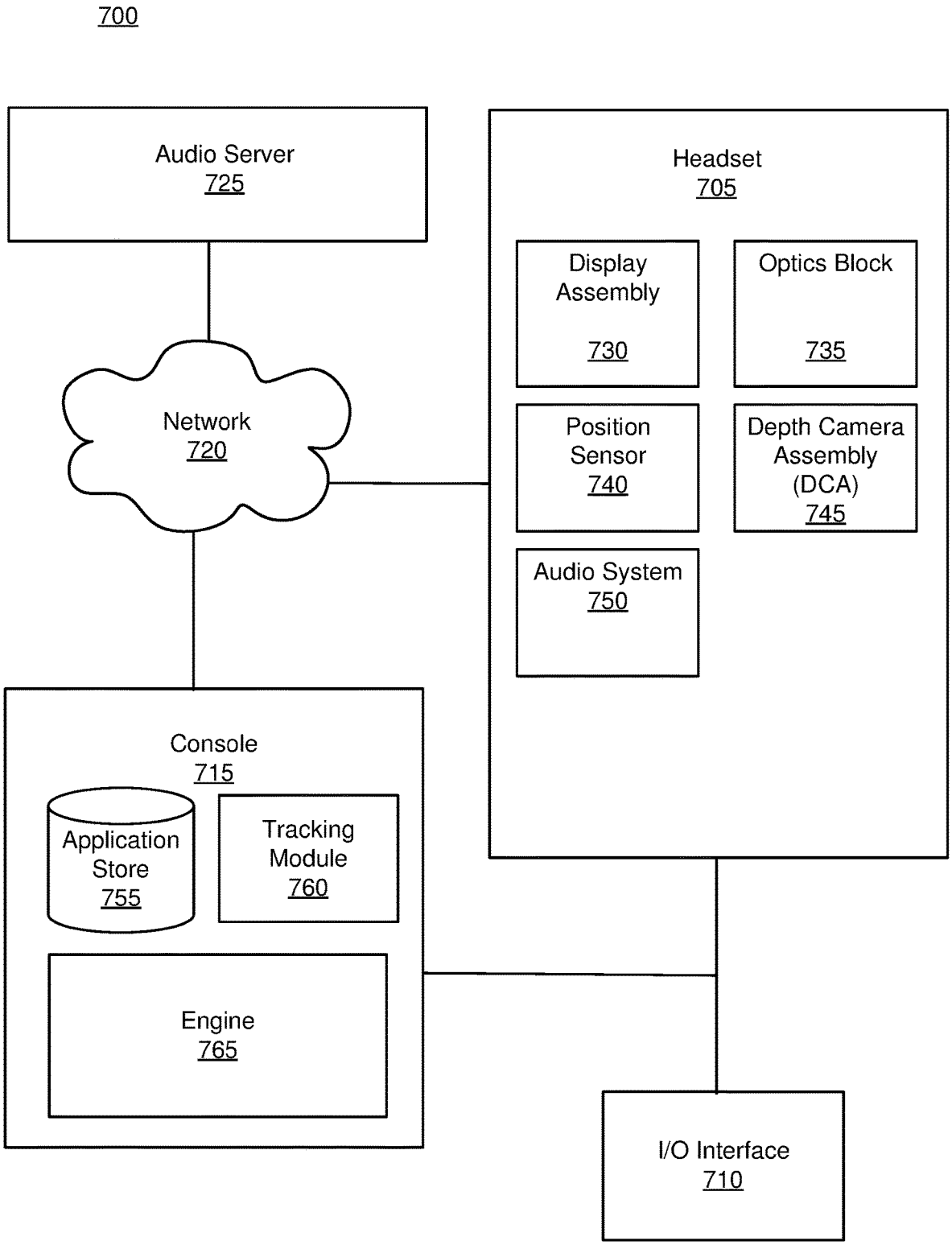
FIG. 7 is a system that includes a headset, in accordance with one or more embodiments.

FIG. 7 is a system 700 that includes a headset 705, in accordance with one or more embodiments. In some embodiments, the headset 705 may be the headset 100 of FIG. 1A or the headset 105 of FIG. 1B. The system 700 may operate in an artificial reality environment (e.g., a virtual reality environment, an augmented reality environment, a mixed reality environment, or some combination thereof). The system 700 shown by FIG. 7 includes the headset 705, an input/output (I/O) interface 710 that is coupled to a console 715, the network 720, and the audio server 725. While FIG. 7 shows an example system 700 including one headset 705 and one I/O interface 710, in other embodiments any number of these components may be included in the system 700. For example, there may be multiple headsets each having an associated I/O interface 710, with each headset and I/O interface 710 communicating with the console 715. In alternative configurations, different and/or additional components may be included in the system 700. Additionally, functionality described in conjunction with one or more of the components shown in FIG. 7 may be distributed among the components in a different manner than described in conjunction with FIG. 7 in some embodiments. For example, some or all of the functionality of the console 715 may be provided by the headset 705.

The headset 705 includes the display assembly 730, an optics block 735, one or more position sensors 740, and the DCA 745. Some embodiments of headset 705 have different components than those described in conjunction with FIG. 7. Additionally, the functionality provided by various components described in conjunction with FIG. 7 may be differently distributed among the components of the headset 705 in other embodiments, or be captured in separate assemblies remote from the headset 705.

The display assembly 730 displays content to the user in accordance with data received from the console 715. The display assembly 730 displays the content using one or more display elements (e.g., the display elements 120). A display element may be, e.g., an electronic display. In various embodiments, the display assembly 730 comprises a single display element or multiple display elements (e.g., a display for each eye of a user). Examples of an electronic display include: a liquid crystal display (LCD), an organic light emitting diode (OLED) display, an active-matrix organic light-emitting diode display (AMOLED), a waveguide display, some other display, or some combination thereof. Note in some embodiments, the display element 120 may also include some or all of the functionality of the optics block 735.

The optics block 735 may magnify image light received from the electronic display, corrects optical errors associated with the image light, and presents the corrected image light to one or both eyeboxes of the headset 705. In various embodiments, the optics block 735 includes one or more optical elements. Example optical elements included in the optics block 735 include: an aperture, a Fresnel lens, a convex lens, a concave lens, a filter, a reflecting surface, or any other suitable optical element that affects image light. Moreover, the optics block 735 may include combinations of different optical elements. In some embodiments, one or more of the optical elements in the optics block 735 may have one or more coatings, such as partially reflective or anti-reflective coatings.

Magnification and focusing of the image light by the optics block 735 allows the electronic display to be physically smaller, weigh less, and consume less power than larger displays. Additionally, magnification may increase the field of view of the content presented by the electronic display. For example, the field of view of the displayed content is such that the displayed content is presented using almost all (e.g., approximately 110 degrees diagonal), and in some cases, all of the user's field of view. Additionally, in some embodiments, the amount of magnification may be adjusted by adding or removing optical elements.

In some embodiments, the optics block 735 may be designed to correct one or more types of optical error. Examples of optical error include barrel or pincushion distortion, longitudinal chromatic aberrations, or transverse chromatic aberrations. Other types of optical errors may further include spherical aberrations, chromatic aberrations, or errors due to the lens field curvature, astigmatisms, or any other type of optical error. In some embodiments, content provided to the electronic display for display is pre-distorted, and the optics block 735 corrects the distortion when it receives image light from the electronic display generated based on the content.

The position sensor 740 is an electronic device that generates data indicating a position of the headset 705. The position sensor 740 generates one or more measurement signals in response to motion of the headset 705. The position sensor 190 is an embodiment of the position sensor 740. Examples of a position sensor 740 include: one or more IMUS, one or more accelerometers, one or more gyroscopes, one or more magnetometers, another suitable type of sensor that detects motion, or some combination thereof. The position sensor 740 may include multiple accelerometers to measure translational motion (forward/back, up/down, left/right) and multiple gyroscopes to measure rotational motion (e.g., pitch, yaw, roll). In some embodiments, an IMU rapidly samples the measurement signals and calculates the estimated position of the headset 705 from the sampled data. For example, the IMU integrates the measurement signals received from the accelerometers over time to estimate a velocity vector and integrates the velocity vector over time to determine an estimated position of a reference point on the headset 705. The reference point is a point that may be used to describe the position of the headset 705. While the reference point may generally be defined as a point in space, however, in practice the reference point is defined as a point within the headset 705.

The DCA 745 generates depth information for a portion of the local area. The DCA includes one or more imaging devices and a DCA controller. The DCA 745 may also include an illuminator. Operation and structure of the DCA 745 is described above with regard to FIG. 1A.

The audio system 750 provides audio content to a user of the headset 705. The audio system 750 is substantially the same as the audio system 500 describe above. The audio system 750 may comprise one or more acoustic sensors, one or more transducers, and an audio controller. The audio system 750 may collect test information for the user using the one or more acoustic sensors and transducers. The audio system 750 may transmit collected test information to audio server 725, and may receive HRTFs for the user from the audio server 725. Alternatively, the audio system 725 may use the collected test information to determine HRTFs locally, such as by using a trained HRTF model received from the audio server 725. The audio system 750 may provide spatialized audio content to the user (e.g. using HRTFs for the user). In some embodiments, the audio system 750 may request acoustic parameters from the audio server 725 over the network 720. The acoustic parameters describe one or more acoustic properties (e.g., room impulse response, a reverberation time, a reverberation level, etc.) of the local area. The audio system 750 may provide information describing at least a portion of the local area from e.g., the DCA 745 and/or location information for the headset 705 from the position sensor 740. The audio system 750 may generate one or more sound filters using one or more of the acoustic parameters received from the audio server 725, and use the sound filters to provide audio content to the user.

The I/O interface 710 is a device that allows a user to send action requests and receive responses from the console 715. An action request is a request to perform a particular action. For example, an action request may be an instruction to start or end capture of image or video data, or an instruction to perform a particular action within an application. The I/O interface 710 may include one or more input devices. Example input devices include: a keyboard, a mouse, a game controller, or any other suitable device for receiving action requests and communicating the action requests to the console 715. An action request received by the I/O interface 710 is communicated to the console 715, which performs an action corresponding to the action request. In some embodiments, the I/O interface 710 includes an IMU that captures calibration data indicating an estimated position of the I/O interface 710 relative to an initial position of the I/O interface 710. In some embodiments, the I/O interface 710 may provide haptic feedback to the user in accordance with instructions received from the console 715. For example, haptic feedback is provided when an action request is received, or the console 715 communicates instructions to the I/O interface 710 causing the I/O interface 710 to generate haptic feedback when the console 715 performs an action.

The console 715 provides content to the headset 705 for processing in accordance with information received from one or more of: the DCA 745, the headset 705, and the I/O interface 710. In the example shown in FIG. 7, the console 715 includes an application store 755, a tracking module 760, and an engine 765. Some embodiments of the console 715 have different modules or components than those described in conjunction with FIG. 7. Similarly, the functions further described below may be distributed among components of the console 715 in a different manner than described in conjunction with FIG. 7. In some embodiments, the functionality discussed herein with respect to the console 715 may be implemented in the headset 705, or a remote system.

The application store 755 stores one or more applications for execution by the console 715. An application is a group of instructions, that when executed by a processor, generates content for presentation to the user. Content generated by an application may be in response to inputs received from the user via movement of the headset 705 or the I/O interface 710. Examples of applications include: gaming applications, conferencing applications, video playback applications, or other suitable applications.

The tracking module 760 tracks movements of the headset 705 or of the I/O interface 710 using information from the DCA 745, the one or more position sensors 740, or some combination thereof. For example, the tracking module 760 determines a position of a reference point of the headset 705 in a mapping of a local area based on information from the headset 705. The tracking module 760 may also determine positions of an object or virtual object. Additionally, in some embodiments, the tracking module 760 may use portions of data indicating a position of the headset 705 from the position sensor 740 as well as representations of the local area from the DCA 745 to predict a future location of the headset 705. The tracking module 760 provides the estimated or predicted future position of the headset 705 or the I/O interface 710 to the engine 765.

The engine 765 executes applications and receives position information, acceleration information, velocity information, predicted future positions, or some combination thereof, of the headset 705 from the tracking module 760. Based on the received information, the engine 765 determines content to provide to the headset 705 for presentation to the user. For example, if the received information indicates that the user has looked to the left, the engine 765 generates content for the headset 705 that mirrors the user's movement in a virtual local area or in a local area augmenting the local area with additional content. Additionally, the engine 765 performs an action within an application executing on the console 715 in response to an action request received from the I/O interface 710 and provides feedback to the user that the action was performed. The provided feedback may be visual or audible feedback via the headset 705 or haptic feedback via the I/O interface 710.

The network 720 couples the headset 705 and/or the console 715 to the audio server 725. The network 720 may include any combination of local area and/or wide area networks using both wireless and/or wired communication systems. For example, the network 720 may include the Internet, as well as mobile telephone networks. In one embodiment, the network 720 uses standard communications technologies and/or protocols. Hence, the network 720 may include links using technologies such as Ethernet, 802.11, worldwide interoperability for microwave access (WiMAX), 2G/3G/4G mobile communications protocols, digital subscriber line (DSL), asynchronous transfer mode (ATM), InfiniBand, PCI Express Advanced Switching, etc. Similarly, the networking protocols used on the network 720 can include multiprotocol label switching (MPLS), the transmission control protocol/Internet protocol (TCP/IP), the User Datagram Protocol (UDP), the hypertext transport protocol (HTTP), the simple mail transfer protocol (SMTP), the file transfer protocol (FTP), etc. The data exchanged over the network 720 can be represented using technologies and/or formats including image data in binary form (e.g., Portable Network Graphics (PNG)), hypertext markup language (HTML), extensible markup language (XML), etc. In addition, all or some of links can be encrypted using conventional encryption technologies such as secure sockets layer (SSL), transport layer security (TLS), virtual private networks (VPNs), Internet Protocol security (IPsec), etc.

The audio server 725 provides information to the headset 705 for processing in accordance with information received from one or more of: the headset 705, the console 715, and the I/O interface 710. The audio server 725 is substantially the same as the audio server 300 describe above. The audio server 725 processes test information received from the headset 705 in order to determine HRTFs for a user of the headset 705. The audio server 725 may provide determined HRTFs to the headset 705. In some embodiments, the audio server 705 may determine geometric information for a user of the headset 705 describing the geometry of the pinnae of the user. The audio server 725 may process the determined geometric information to determine HRTFs for the user, and/or may provide the geometric information to the headset 705.

The audio server 725 may include a database that stores a virtual model describing a plurality of spaces, wherein one location in the virtual model corresponds to a current configuration of a local area of the headset 705. The audio server 725 receives, from the headset 705 via the network 720, information describing at least a portion of the local area and/or location information for the local area. The user may adjust privacy settings to allow or prevent the headset 705 from transmitting information to the audio server 725. The audio server 725 determines, based on the received information and/or location information, a location in the virtual model that is associated with the local area of the headset 705. The audio server 725 determines (e.g., retrieves) one or more acoustic parameters associated with the local area, based in part on the determined location in the virtual model and any acoustic parameters associated with the determined location. The audio server 725 may transmit the location of the local area and any values of acoustic parameters associated with the local area to the headset 705.

One or more components of system 700 may contain a privacy module that stores one or more privacy settings for user data elements. The user data elements describe the user or the headset 705. For example, the user data elements may describe a physical characteristic of the user, an action performed by the user, a location of the user of the headset 705, a location of the headset 705, an HRTF for the user, etc. Privacy settings (or "access settings") for a user data element may be stored in any suitable manner, such as, for example, in association with the user data element, in an index on an authorization server, in another suitable manner, or any suitable combination thereof.

A privacy setting for a user data element specifies how the user data element (or particular information associated with the user data element) can be accessed, stored, or otherwise used (e.g., viewed, shared, modified, copied, executed, surfaced, or identified). In some embodiments, the privacy settings for a user data element may specify a "blocked list" of entities that may not access certain information associated with the user data element. The privacy settings associated with the user data element may specify any suitable granularity of permitted access or denial of access. For example, some entities may have permission to see that a specific user data element exists, some entities may have permission to view the content of the specific user data element, and some entities may have permission to modify the specific user data element. The privacy settings may allow the user to allow other entities to access or store user data elements for a finite period of time.

The privacy settings may allow a user to specify one or more geographic locations from which user data elements can be accessed. Access or denial of access to the user data elements may depend on the geographic location of an entity who is attempting to access the user data elements. For example, the user may allow access to a user data element and specify that the user data element is accessible to an entity only while the user is in a particular location. If the user leaves the particular location, the user data element may no longer be accessible to the entity. As another example, the user may specify that a user data element is accessible only to entities within a threshold distance from the user, such as another user of a headset within the same local area as the user. If the user subsequently changes location, the entity with access to the user data element may lose access, while a new group of entities may gain access as they come within the threshold distance of the user.

The system 700 may include one or more authorization/privacy servers for enforcing privacy settings. A request from an entity for a particular user data element may identify the entity associated with the request and the user data element may be sent only to the entity if the authorization server determines that the entity is authorized to access the user data element based on the privacy settings associated with the user data element. If the requesting entity is not authorized to access the user data element, the authorization server may prevent the requested user data element from being retrieved or may prevent the requested user data element from being sent to the entity. Although this disclosure describes enforcing privacy settings in a particular manner, this disclosure contemplates enforcing privacy settings in any suitable manner.

Additional Configuration Information

The foregoing description of the embodiments has been presented for illustration; it is not intended to be exhaustive or to limit the patent rights to the precise forms disclosed.

Persons skilled in the relevant art can appreciate that many modifications and variations are possible considering the above disclosure.

Some portions of this description describe the embodiments in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all the steps, operations, or processes described.

Embodiments may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the patent rights. It is therefore intended that the scope of the patent rights be limited not by this detailed description, but rather by any claims that issue on an application based hereon. Accordingly, the disclosure of the embodiments is intended to be illustrative, but not limiting, of the scope of the patent rights, which is set forth in the following claims.

What is claimed is:

1. An audio system comprising:

a cartilage conduction transducer coupled to a pinna of a user of the audio system;

a microphone positioned at an entrance to an ear canal of the user; and a controller configured to:

instruct the cartilage conduction transducer to present a test sound;

receive an audio signal that was detected by the microphone responsive to the test sound;

determine a head related transfer function (HRTF) for the user using a model, the test sound, and the audio signal, wherein the model maps combinations of audio signals and test sounds to corresponding head related transfer functions (HRTFs);

generate audio content using the HRTF; and instruct the cartilage conduction transducer to present the audio content to the user.

2. The audio system of claim 1, wherein the cartilage conduction transducer is configured to present the test sound at a test position on the pinna of the user.

3. The audio system of claim 2, wherein the model maps the combinations of the audio signals and the test sounds to the corresponding HRTFs for various test positions of the cartilage conduction transducer.

4. The audio system of claim 1, wherein the audio system is further configured to:

prompt the user to move the cartilage conduction transducer to each of a plurality of test positions on the pinna, wherein at each test position the audio system is configured to present one or more respective test sounds by the cartilage conduction transducer and receive one or more corresponding audio signals detected by the microphone.

5. The audio system of claim 4, wherein at each test position the audio system presents a plurality of test sounds, and each test sound is the same.

6. The audio system of claim 4, wherein at each test position the audio system presents a plurality of test sounds and at least one test sound of the plurality of test sounds is different from another test sound of the plurality of test sounds.

7. An audio system comprising:

a cartilage conduction transducer coupled to a pinna of a user of the audio system;

a microphone positioned at an entrance to an ear canal of the user; and a controller configured to:

instruct the cartilage conduction transducer to present a test sound;

receive an audio signal that was detected by the microphone responsive to the test sound;

determine geometric information describing the pinna of the user using a model, the test sound, and the audio signal, wherein the model maps combinations of audio signals and test sounds to corresponding geometric information that describes the pinna of the user;

generate audio content using the geometric information; and instruct the cartilage conduction transducer to present the audio content to the user.

8. The audio system of claim 7, wherein the cartilage conduction transducer is configured to present the test sound at a test position on the pinna of the user.

9. The audio system of claim 7, wherein the model maps the combinations of the audio signals and the test sounds to the corresponding geometric information for various test positions of the cartilage conduction transducer.

10. The audio system of claim 7, wherein the audio system is further configured to:

prompt the user to move the cartilage conduction transducer to each of a plurality of test positions on the pinna, wherein at each test position the audio system is configured to present one or more respective test sounds by the cartilage conduction transducer and receive one or more corresponding audio signals detected by the microphone.

11. The audio system of claim 10, wherein at each test position the audio system presents a plurality of test sounds, and each test sound is the same.

12. The audio system of claim 10, wherein at each test position the audio system presents a plurality of test sounds and at least one test sound of the plurality of test sounds is different from another test sound of the plurality of test sounds.

13. The audio system of claim 7, wherein the controller is further configured to:

determine a head related transfer function (HRTF) for the user using the geometric information.

14. The audio system of claim 13, wherein the controller is further configured to:

perform a simulation that uses the geometric information to determine the HRTF.

15. A non-transitory computer-readable storage medium storing instructions that, when executed by one or more processors, cause the one or more processors to perform steps comprising:

instructing a cartilage conduction transducer to present a test sound, the cartilage conduction transducer coupled to a pinna of a user of an audio system;

receiving an audio signal that was detected by a microphone responsive to the test sound, the microphone positioned at an entrance to an ear canal of the user;

determining a head related transfer function (HRTF) for the user using a model, the test sound, and the audio signal, wherein the model maps combinations of audio signals and test sounds to corresponding head related transfer functions (HRTFs);

generating audio content using the HRTF; and instructing the cartilage conduction transducer to present the audio content.

16. The computer-readable storage medium of claim 15, wherein the cartilage conduction transducer is configured to present the test sound at a test position on the pinna of the user.

17. The computer-readable storage medium of claim 16, wherein the model maps the combinations of the audio signals and the test sounds to the corresponding HRTFs for various test positions of the cartilage conduction transducer.

18. The computer-readable storage medium of claim 15, wherein the steps further comprise:

instructing the audio system to prompt the user to move the cartilage conduction transducer to each of a plurality of test positions on the pinna; and instructing the cartilage conduction transducer to present, at each of the plurality of test positions, one or more respective test sounds.

19. The computer-readable storage medium of claim 18, wherein the steps further comprise:

instructing the cartilage conduction transducer to present a plurality of test sounds at each of the plurality of test positions, and each of the plurality of test sounds is the same.

20. The computer-readable storage medium of claim 18, wherein the steps further comprise:

instructing the cartilage conduction transducer to present a plurality of test sounds at each of the plurality of test positions, wherein at least one test sound of the plurality of test sounds is different from another test sound of the plurality of test sounds.

* * * * *